US008600738B2

(12) United States Patent
Zhan et al.

(10) Patent No.: US 8,600,738 B2
(45) Date of Patent: Dec. 3, 2013

(54) METHOD, SYSTEM, AND DEVICE FOR PERFORMING PACKET LOSS CONCEALMENT BY SUPERPOSING DATA

(75) Inventors: Wuzhou Zhan, Shenzhen (CN); Dongqi Wang, Shenzhen (CN)

(73) Assignee: Huawei Technologies Co., Ltd., Shenzhen, Guangdong (CN)

( * ) Notice: Subject to any disclaimer, the term of this patent is extended or adjusted under 35 U.S.C. 154(b) by 750 days.

(21) Appl. No.: 12/610,466

(22) Filed: Nov. 2, 2009

(65) Prior Publication Data

US 2010/0049506 A1 Feb. 25, 2010

Related U.S. Application Data

(63) Continuation of application No. PCT/CN2008/071313, filed on Jun. 13, 2008.

(30) Foreign Application Priority Data

Jun. 14, 2007 (CN) ..... 2007 1 0126165

(51) Int. Cl.
*G10L 11/04* (2006.01)
*G10L 19/04* (2006.01)

(52) U.S. Cl.
USPC ..... 704/207

(58) Field of Classification Search
USPC ..... 704/207
See application file for complete search history.

(56) References Cited

U.S. PATENT DOCUMENTS

| | | | |
|---|---|---|---|
| 5,574,825 | A | 11/1996 | Chen et al. |
| 5,619,004 | A | 4/1997 | Dame |
| 5,717,818 | A | 2/1998 | Nejime et al. |
| 6,167,375 | A | 12/2000 | Miseki et al. |

(Continued)

FOREIGN PATENT DOCUMENTS

| | | | |
|---|---|---|---|
| CN | 1412742 | A | 4/2003 |
| CN | 1441950 | A | 9/2003 |

(Continued)

OTHER PUBLICATIONS

Extended European Search Report dated (mailed) May 17, 2010, issued in related Application No. 08757724.3-1224, PCT/CN2008071313, filed Jun. 13, 2008, Hauwei Technologies Co., Ltd.

(Continued)

*Primary Examiner* — Susan McFadden
(74) *Attorney, Agent, or Firm* — Finnegan, Henderson, Farabow, Garrett & Dunner, LLP

(57) ABSTRACT

A method, device and system to implement hiding the loss packet are provided. The provided method, device and system recover the lost frame according to the data before and after the lost frame and enhances the correlation of the recovered lost frame data and the data after the lost frame. A method and device for estimating pitch period are also provided which select a pitch period from the initial pitch period and the pitch periods corresponding to the frequencies which are one or more times higher than the frequencies corresponding to the initial pitch period as the final estimated pitch period, may improve frequency multiplication when estimating the pitch period; in addition, by tuning of the pitch period by matching the waves, the error of estimating pitch period may be reduced and the quality of the audio data may be improved.

23 Claims, 14 Drawing Sheets

(56) References Cited

U.S. PATENT DOCUMENTS

| | | | | |
|---|---|---|---|---|
| 6,418,408 | B1 | 7/2002 | Udaya Bhaskar et al. | |
| 6,510,407 | B1 | 1/2003 | Wang | |
| 6,584,438 | B1 | 6/2003 | Manjunath et al. | |
| 6,757,654 | B1 | 6/2004 | Westerlund et al. | |
| 6,763,329 | B2 | 7/2004 | Brandel et al. | |
| 6,829,578 | B1 | 12/2004 | Huang et al. | |
| 6,952,668 | B1 | 10/2005 | Kapilow | |
| 7,047,190 | B1 | 5/2006 | Kapilow | |
| 7,117,156 | B1 | 10/2006 | Kapilow | |
| 7,324,444 | B1 | 1/2008 | Liang et al. | |
| 7,552,048 | B2 * | 6/2009 | Xu et al. | 704/206 |
| 7,653,536 | B2 | 1/2010 | Tackin et al. | |
| 7,693,710 | B2 | 4/2010 | Jelinek et al. | |
| 7,835,912 | B2 * | 11/2010 | Zhan et al. | 704/262 |
| 7,869,990 | B2 * | 1/2011 | Gao | 704/207 |
| 7,881,925 | B2 * | 2/2011 | Kapilow | 704/201 |
| 7,930,176 | B2 * | 4/2011 | Chen | 704/228 |
| 7,957,961 | B2 * | 6/2011 | Zhan et al. | 704/219 |
| 8,000,960 | B2 * | 8/2011 | Chen et al. | 704/219 |
| 8,078,458 | B2 * | 12/2011 | Zopf et al. | 704/219 |
| 8,185,388 | B2 * | 5/2012 | Gao | 704/228 |
| 8,320,265 | B2 * | 11/2012 | Zhan et al. | 370/252 |
| 2002/0069052 | A1 | 6/2002 | Chen | |
| 2003/0220787 | A1 | 11/2003 | Svensson et al. | |
| 2004/0120309 | A1 | 6/2004 | Kurittu et al. | |
| 2005/0055204 | A1 | 3/2005 | Florencio et al. | |
| 2005/0143983 | A1 | 6/2005 | Chang et al. | |
| 2007/0088540 | A1 | 4/2007 | Ohta et al. | |
| 2009/0316598 | A1 | 12/2009 | Zhan et al. | |
| 2010/0049505 | A1 | 2/2010 | Zhan et al. | |
| 2010/0049506 | A1 | 2/2010 | Zhan et al. | |
| 2010/0049510 | A1 | 2/2010 | Zhan et al. | |
| 2010/0228542 | A1 | 9/2010 | Zhan | |
| 2010/0305953 | A1 | 12/2010 | Susan et al. | |
| 2012/0101814 | A1 * | 4/2012 | Elias | 704/207 |

FOREIGN PATENT DOCUMENTS

| | | | |
|---|---|---|---|
| CN | 1901431 | A | 1/2007 |
| CN | 1971707 | A | 5/2007 |
| CN | 101887723 | B | 4/2012 |
| CN | 101833954 | B | 7/2012 |
| EP | 1 335 349 | A2 | 8/2003 |
| JP | 2006-220806 | A | 8/2006 |
| KR | 20070059860 | | 6/2007 |
| WO | WO 00/63885 | | 10/2000 |
| WO | WO 02/07061 | A2 | 1/2002 |
| WO | WO 02/17301 | A1 | 2/2002 |
| WO | WO 03/090204 | A1 | 10/2003 |

OTHER PUBLICATIONS

Kondoz, A.M.,"Pitch Estimation and Voiced-Unvoiced Classification of Speech," XP-002580814, *Digital Speech: Coding for Low Bit Rate Communication Systems*, 2004, John Wiley & Sons, Ltd.

European Patent Office Communication pursuant to Article 94(3) EPC, European search opinion for Application No. 08757724.3-1224, mailed Sep. 20, 2010, Huawei Technologies C., LTD 4 pgs.

Wang S. et al.: "Improved phonetically-segmented vector excitation coding at 3.4 kb/s" Speech Processing 1. San Francisco, Mar. 23-26, 1992; [Proceedings of the International Conference on Acoustics, Speech and Signal Processing (ICASSP)], New York, IEEE, US LNKD-DOI:10.1109/ICASSP.1992.225900, vol. 1, Mar. 23, 1992, pp. 349-352, ISBN:978-0-7803-0532-8.

Hermansson H. et al, "A speech codec for cellular radio at a gross bit rate of 11.4 kb/s" Speech Processing 1, Toronto, May 14-17, 1991; [International Conference on Acoustics, Speech & Signal Processing. ICASSP], New York, IEEE, US LNKD-DOI;10.1109/ICASSP.1991.150417, vol. CONF. 16, Apr. 14, 1991, pp. 625-628, ISBN: 978-0-7803-0003-3.

Extended European Search Report dated (mailed) Nov. 4, 2010, issued in related Application No. 10002537.8-1224/2200019, filed Jun. 13, 2008 , Huawei Technologies Co., Ltd.

Svensson H. et al., "Implementation Aspects of a Novel Speech Packet Loss Concealment Method," Conference Proceedings/ IEEE International Symposium on Circuits and Systems (ISCAS) : May 23-26, 2005, International Conference Center, Kobe, Japan, IEEE Service center, Piscataway, NJ LNKD-DOI:10.1109/ISCAS.2005.1465225, May 23, 2005, pp. 2867-2870, XP010816190.

Aoki, N. et al., "Development of a VOIP System Implementing a High Quality Packet Loss Concealment Technique," Electrical and Computer Engineering, 2005. Canadian Conference on, Saskatoon, SK, Canada, May 1-4, 2005, Piscataway, NJ, USA< IEEE LNKD-DOI:10.1109/CCECE.2005.1556934, May 1, 2005, pp. 308-311, XP010868812.

Extended European Search Report dated (mailed) Nov. 4, 2010, issued in related Application No. 10002536.0-1224/2200018, filed Jun. 13, 2008 , Huawei Technologies Co., Ltd.

Aoki N., "A VolP Packet Loss Concealment Technique Taking Account of Pitch Variation in Pitch Wafeform Replication," Electronics & Communications in Japan Part I—Communications, Wiley, Hoboken, NJ, US LNKD—DOI:10.1002/ECJA.20268, vol. 89, No. 3, Part 01, Mar. 1, 2006, pp. 1-09, XP001238449.

Goodman D.J. et al., "Waveform Substitution Techniques for Recovering Missing Speech Segments in Packet Voice Communications," IEEE Transactionson Acoustics, Speech and Signal Processing, IEEE Inc., New York, USA LNKD- DOI:10.1109/TASSP. 1986.1164984, vol. ASSP-34, No. 6, Dec. 1, 1986, pp. 1440-1448, XP002973610.

Wen-Tsai Liao et al., "Adaptive Recovery Techniques for Real-Time Audio Streams," Proceedings IEEE INFOCOM 2001, Conference on Computer Communications, Twentieth Annual Joint Converence of the IEEE Computer and Communicatins Society (Cat. No. 01CH37213); [Proceedings IEEE INFOCOM. The Conference on Cumputer Communications, PISCAT, vol. 2, Apr. 22, 2001, pp. 815-823, XP010538767.

"Pulse Code Modulation (PCM) of Voice Frequencies Appendix I: A High Quality Low-Complexity Algorithm for Packet Loss Concealment with G.711," ITU-T Recommendations, International Telecommendation Union, Geneva, CH, vol. G.711, Sep. 1, 1999, pp. I-III, 01, XP001181238.

Written Opinion of the International Searching Authority (translation) dated (mailed) Sep. 25, 2008, issued in related Application No. PCT/CN2008/071313, filed Jun. 13, 2008, Huawei Technologies Co., Ltd.

International Search Report from P.R. China in International Application No. PCT/CN2008/071313 mailed Sep. 25, 2008.

First Chinese Office Action dated (mailed) Nov. 2, 2011, issued in related Chinese Application No. 2011010158666.1 Huawei Technologies Co., LTD.

US Office Action dated (mailed) Oct. 27, 2011, issued in related U.S. Appl. No. 12/640,442, Wushou Zhan, Huawei Technologies Co., Ltd.

U.S. Office Action dated (mailed) Nov. 9, 2011, issued in related U.S. Appl. No. 12/610,489, Wuzhou Zhan, Huawei Technologies Co., Ltd.

US Office Action for U.S. Appl. No. 12/610,442, filed Nov. 2, 2009; mailed on Apr. 11, 2012; Wuzhou Zhan; Huawei Tech Co., Ltd.

Liao, Wen-Tsai, et al., "Adaptive Recovery Techniques for Real-Time Audio Streams", In Proceedings IEEE Infocom 2001, Apr. 2001 (9 pages).

* cited by examiner

METHOD, SYSTEM, AND DEVICE FOR PERFORMING PACKET LOSS CONCEALMENT BY SUPERPOSING DATA

CROSS-REFERENCE TO RELATED APPLICATIONS

This application is a continuation of PCT International Application No. PCT/CN2008/071313, filed on Jun. 13, 2008, which claims priority to Chinese Patent Application No 200710126165.3, filed Jun. 14, 2007, entitled "Method and Device for Performing Packet Loss Concealment", commonly assigned. The contents of these applications are hereby incorporated by reference herein in their entirety.

TECHNICAL FIELD

The present disclosure relates to a network communication technology field, and in particular, to a method and a device for estimating a pitch period, a method and a device for tuning the pitch period, and a method, a device and a system for performing packet loss concealment (PLC).

BACKGROUND

Originally, the Internet Protocol (IP) network is designed for the transmission of data streams with large packets. At present, voice data is also transmitted over an IP network. During transmission of voice data, small voice packets need to be transmitted in a real-time and reliable manner. When a voice packet is discarded during transmission, the packet cannot be transmitted again due to lack of time. In addition, the existence of such a voice packet is of no significance if the voice packet takes a long route and fails to arrive at the destination address in time when the voice packet needs to be played. Therefore, a voice packet is regarded as a lost packet if the voice packet fails to arrive at the destination address in time or does not arrive at the destination address in a Voice over Internet Protocol (VoIP) system.

Packet loss is the main reason for the deterioration of the service quality when the voice data is transmitted on the network. With the PLC technology, however, a lost packet is compensated with a synthetic packet to reduce the impact of packet loss on the voice quality during data transmission. Without an efficient voice PLC technology, the IP network cannot provide communication with the toll call quality even though the IP network is designed and managed with the highest standard. With a well-designed technology of solving the packet loss problem, the quality of voice transmission can be greatly improved. Therefore, different mechanisms in the existing technology are used to reduce the impact of packet loss. For example, the pitch waveform substitution serves as a basic PLC method.

The pitch waveform substitution is a processing technology that is implemented at the receiving end. With this technology, a lost data frame can be compensated on the basis of the voice characteristics. The principle, implementation process, and disadvantages of the pitch waveform substitution technology are described below.

In a voice signal, the surd waveform is disordered, but the sonant waveform is in periodic mode. The principle for pitch waveform substitution is as follows: First, the information about the frame before the lost frame, that is, the signal of the previous frame in the notch of waveform is adapted to estimate the pitch period (P) corresponding to the signal waveform before the notch. Then, a waveform at a length of P before the notch is adapted to compensate the notch of waveform.

With the existing technology, generally the autocorrelation analysis method is adopted to obtain the pitch period (P) that is used for pitch waveform substitution. Autocorrelation analysis is a common method of analyzing the voice time domain waveform that is defined by a correction function. The correction function is adapted to measure the affinity of time domains between signals. When two relevant signals are different, the value of the correction function approaches zero; when the waveforms of the two relevant signals are the same, the peak value appears before or after the waveform. Therefore, the autocorrelation function is adapted to research the signal itself, such as the synchronism and periodicity of the waveform.

However, existing methods for compensating a lost frame with a pitch waveform have the following disadvantages:

1) The pitch period (P) of sonant that is estimated by using the autocorrelation analysis method is not accurate. With the autocorrelation analysis method, the pitch period corresponding to the extreme value of auto-correction function serves as the final pitch period, which may be located in 1/N (N is an integer greater than 1) of frequency corresponding to the actual pitch period; in addition, the goal of estimating the pitch period is to obtain a pitch period of the data that is closest to the lost frame. However, a signal at least 22.5 ms (the corresponding pitch period is the minimum pitch period, that is, 2.5 ms) ahead of a notch must be used when the auto-correction method is adopted to calculate the pitch period. The preceding factors produce an error when the pitch period is calculated. When the pitch data with the error is adapted to fill in the data of a lost frame, the phase at the conjunction point has a sudden change.

2) With the existing technology, only the data before the lost frame, that is, the history data, is adapted to fill in the data of a lost frame. The pitch period in an audio signal is changed gradually. Therefore, the farther the data is from the lost frame, the weaker the correlation between the data and the lost frame becomes. When only the data before the lost frame is adapted to compensate the lost frame, the phase at the conjunction point of the lost frame and the frame after the lost frame may be incontinuous.

3) When the lost frame occurs during gradual change of the voice, the amplitude is incontinuous when only the data of previous pitch period of the lost frame is used for recovery.

SUMMARY

Accordingly, a method for estimating the pitch period is provided in an embodiment of the present disclosure which may solve the problem of frequency multiplication during estimation of the pitch period.

A device for estimating the pitch period is provided in an embodiment of the present disclosure which may solve the problem of frequency multiplication during estimation of the pitch period.

A method for tuning the pitch period is provided in an embodiment of the present disclosure which may reduce the error during estimation of the pitch period.

A device of tuning the pitch period is provided in an embodiment of the present disclosure which may reduce the error when estimating the pitch period.

A method for performing PLC is provided in an embodiment of the present disclosure which may enhance the correlation between the recovered lost frame data and the data after the lost frame.

A device for performing PLC is provided in an embodiment of the present disclosure which may enhance the correlation between the recovered lost frame data and the data after the lost frame.

A method for estimating the pitch period is provided. The method includes:

obtaining the initial pitch period of history data; and selecting one or more pitch periods, whose corresponding frequencies are lower than or equal to the frequency corresponding to the lowest possible pitch period, as candidate pitch periods, said one or more pitch periods' frequencies are one or more times higher than the frequency corresponding to the initial pitch period, and selecting a pitch period from the initial pitch period and the candidate pitch periods as the final estimated pitch period of the history data.

A device for estimating the pitch period is also provided. The device includes:

an initial pitch period obtaining module, adapted to obtain the initial pitch period of history data and send the pitch period to a selecting module; and a selecting module, adapted to select one or more pitch periods, whose corresponding frequencies are lower than or equal to the frequency corresponding to the lowest possible pitch period, as candidate pitch periods, where said one or more pitch periods' frequencies are one or more times higher than the frequency corresponding to the initial pitch period, and select a pitch period from the initial pitch period and the candidate pitch periods as the final estimated pitch period of the history data.

A method for tuning the pitch period is further provided. The method includes:

obtaining an initial pitch period of history data before or after lost data;

setting a template window (TW) whose length uses a preset value at one end where the history data is close to the lost data;

setting a sliding window (SW) whose length is the same as the length of the TW, and sliding the endpoint that is close to the lost data in the SW in the range around a preset point, the preset point is the point at a distance of the length of the initial pitch period from the endpoint where the history data is close to the lost data in the TW; and calculating the matching value of the data in the TW and the SW in the preset range where the SW slides around the preset point, finding the best matching value, and taking the distance between the corresponding endpoints of the TW and SW with the best matching values as the pitch period after the tuning.

A device for tuning the pitch period is also provided. The device includes:

an initial pitch period obtaining unit, adapted to obtain history data before or after the lost data to acquire an initial pitch period, and send the pitch period data to a setting unit;

the setting unit, adapted to receive the initial pitch period that is sent by the initial pitch period obtaining unit, set a template window (TW) whose length uses a preset value at one end where the history data is close to the lost data, set a sliding window (SW) whose length is the same as the length of the TW, and slide the endpoint that is close to the lost data in the SW in the range around the preset point, wherein the preset point is the point at a distance of the length of the initial pitch period from the endpoint where the history data is close to the lost data in the TW; and a calculating unit, adapted to calculate the matching value of the data in the TW and the SW in the preset range where the SW can slide around the preset point, find the best matching value, and take the distance between the corresponding endpoints of the TW and SW with the best matching values as the pitch period after the tuning.

A method for performing PLC is also provided. The method includes:

using data of a pitch period in history data before the lost data to fill in a lost frame buffer (LMB);

using data of a pitch period in the history data before or after the lost data to fill in a temporary lost frame buffer (LTB); and superposing the data in the LMB and the LTB, and using the superposed data to compensate the lost frame.

A device for performing PLC is also provided. The device includes:

a main processing unit, adapted to use data of a pitch period in history data before the lost data to fill in a lost frame buffer (LMB), use data of a pitch period in the history data before or after the lost data to fill in a temporary lost frame buffer (LTB), superpose the data in the LMB and the LTB, and use the superposed data to compensate the lost frame;

the LMB, adapted to store the data that is filled by the main processing unit, the length of the LMB is the same as the length of the lost data; and the LTB, adapted to store the data that is filled by the main processing unit, the length of the LMB is the same as the length of the lost data.

Embodiments consistent with the present disclosure may provide the following benefits when estimating a pitch period: A pitch period, whose corresponding frequency must be lower than or equal to the frequency corresponding to the minimal pitch period, is selected from the pitch periods corresponding to the frequencies that are several times higher than the frequency corresponding to the initial pitch period as the candidate pitch period, and a pitch period is selected from the initial pitch period and candidate pitch period as the final estimated pitch period of the known voice data. In an embodiment of the present disclosure, the error caused by estimating the pitch period may be reduced by the disclosed embodiments. For example, the best matching point among the matching points corresponding to the initial pitch period is found, and tuning of the estimated initial pitch period is performed according to the location of the best matching point. In an embodiment of the present disclosure, the data of a pitch period in history data is used to fill in the LMB, the pitch period data in current data or history data is used to fill in the LTB, the data in the LMB and the LTB are superposed, and then the superposed data is adapted to compensate the lost frame. In this way, the correlation between the recovered lost frame data and the data after the lost frame is enhanced, and the phase continuity between the recovered lost frame data and the data after the lost frame is further improved.

DETAILED DESCRIPTION

In an embodiment of the present disclosure, a method and a device for performing PLC are provided to reduce the error of estimating the pitch period when the lost frame is compensated with the existing technology, and to solve the problems of incontinuous phase and incontinuous amplitude.

First, an improved method for estimating the existing pitch period is provided in an embodiment of the present disclosure.

As mentioned above, the sonant is periodic, and the period of the sonant is (P), that is, the pitch period is P. Therefore, the period of data x of the sampling point in the history buffer (HB) can be expressed with the formula (1):

$$x(m) \approx x(m+P) \tag{1}$$

In addition, the autocorrelation function of periodic function has the same periodic feature with the periodic function. Therefore, the CR function formula related to the signal at the sampling point in the SW and the signal at the sampling point in the TW involving the method for estimating the existing pitch period is as follows:

$$CR(k) = \sum_{m=1}^{W} [SW(m,k) * TW(m)] \tag{2}$$

-continued $$= \sum_{m=1}^{W} [x(m+k-1) * x(LEN-W+m)]$$

The formula (2) can be represented by the formula (3):

$$CR(k) = CR(k+P) \tag{3}$$

Therefore, the best matching point that is found by using the method for calculating the pitch period through autocorrelation analysis in the existing technology may be an interference frequency multiplication point.

Figure 1:
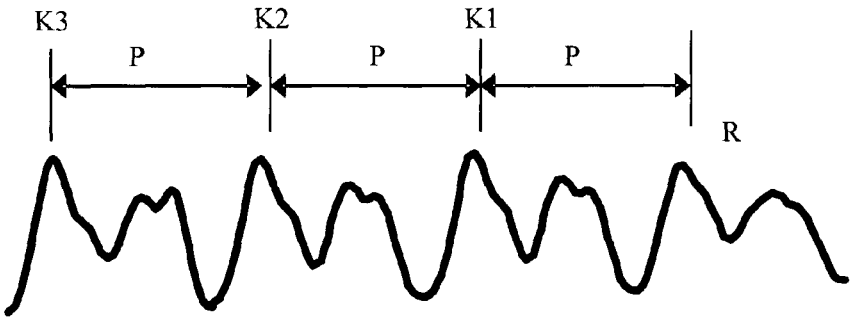
FIG. 1 is a schematic diagram showing a frequency multiplication point according to an embodiment of the present disclosure.

FIG. 1 is a schematic diagram showing a frequency multiplication point according to an embodiment of the present disclosure. As shown in FIG. 1, k3 serves as the best matching point that is obtained by using the autocorrelation analysis method. The best matching point, however, of the actual pitch period of the waveform is k1. That is, the frequency corresponding to the found best matching point k3 is 1/N (N is an integer greater than 1) of the frequency corresponding to k1. Therefore, the pitch period corresponding to the estimated k3 is N times the pitch period corresponding to k1, that is, the pitch period corresponding to the k3 is multiple times the actual pitch period.

Figure 2:
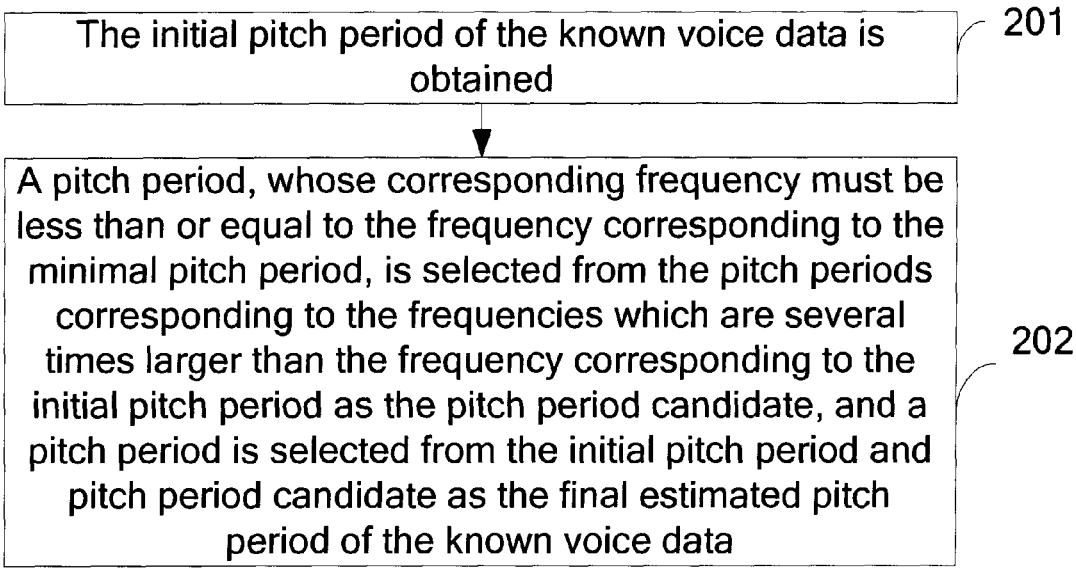
FIG. 2 is a flowchart of a method for estimating a pitch period according to an embodiment of the present disclosure.

FIG. 2 is a flowchart of a method for estimating a pitch period according to an embodiment of the present disclosure. As shown in FIG. 2, the procedure includes the following steps.

Step 201: The initial pitch period of history data is obtained.

In this step, the autocorrelation analysis method can be employed to estimate a pitch period value and to set the value to the initial pitch period value.

Specially, the voice data of a certain length is set to the data in the HB, that is, the data before the lost frame. The ending part of the TW is aligned with the tail of the data in HB, and the starting position of the TW in HB is set to R. The TW location is kept unchanged. The SW slides from the start position of the HB. In the sliding process, the autocorrelation values of sampling points in the SW and TW are calculated to search the best matching point. At the best matching point, the autocorrelation values of signals at the sampling points in the SW and TW are maximal. The distance (P) between the best matching point and the starting position (R) of the TW is the estimated pitch period. In an embodiment of the present disclosure, the estimated pitch period can be set to the initial pitch period.

Step 202: One or more pitch periods, whose corresponding frequency are lower than or equal to the frequency corresponding to the minimal pitch period (2.5 ms), are selected from the pitch periods corresponding to the frequencies that are several times higher than the frequency corresponding to the initial pitch period as the candidate pitch periods, and a pitch period is selected from the initial pitch period and candidate pitch periods as the final estimated pitch period of the known voice data.

In this step, the process of using the pitch periods corresponding to the frequencies that are several times higher than the frequency corresponding to the initial pitch period as the candidate pitch periods is as follows: All the factors of the initial pitch period that are larger than the minimum possible pitch period are found as the candidate pitch periods.

For example, when the initial pitch period is 12 ms and the minimum possible pitch period is 2.5 ms, the factors of 12 ms that are larger than 2.5 ms are 6 ms, 4 ms and 3 ms.

In this step, a final pitch period can be selected from the matching values corresponding to the initial pitch period and candidate pitch periods.

The embodiment shown in FIG. 2 may be employed to solve the frequency multiplication problem caused by estimating the pitch period with the existing technology.

Figure 3:
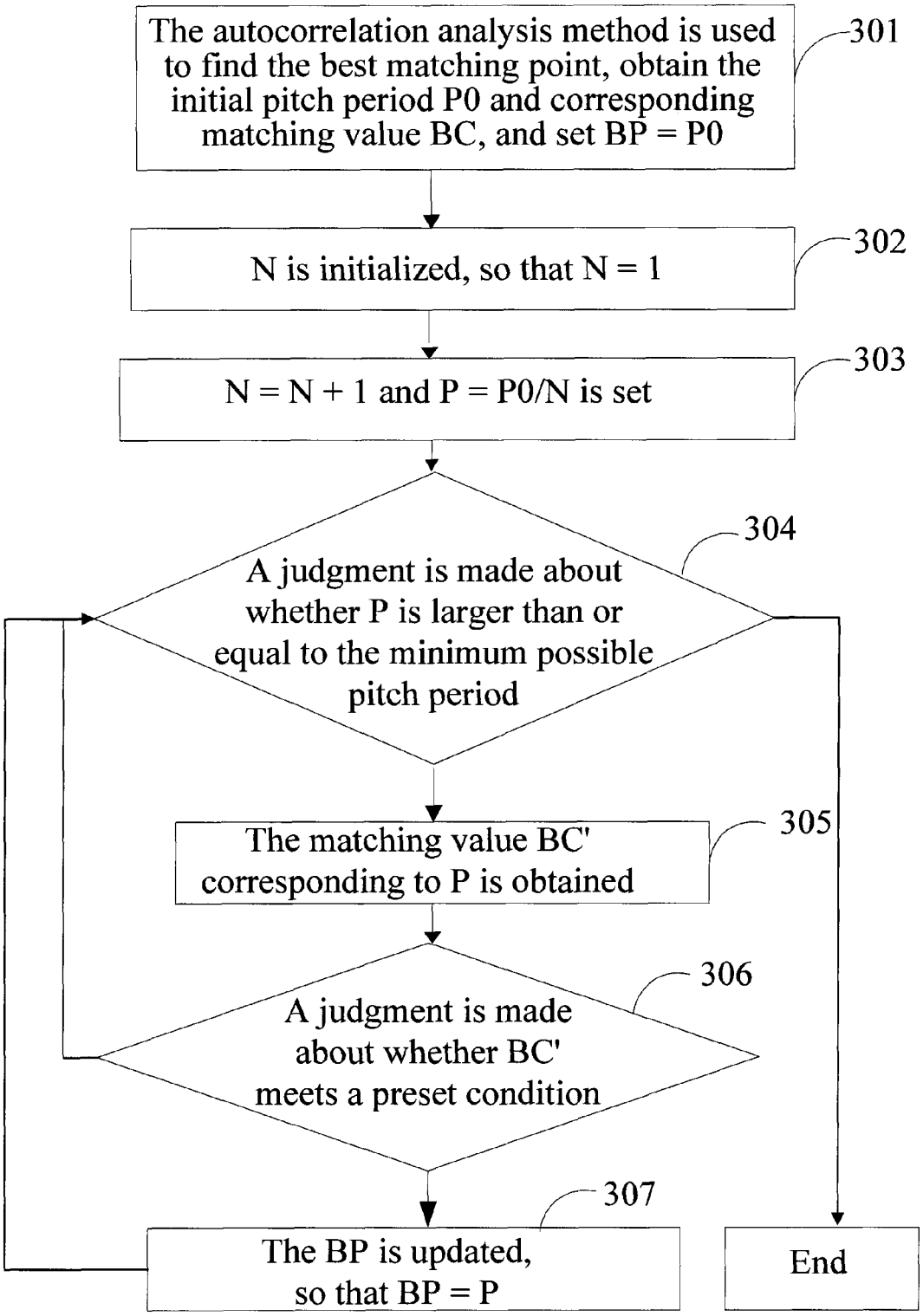
FIG. 3 is a flowchart of realizing the method in FIG. 2 according to an embodiment of the present disclosure.

FIG. 3 is a flowchart of realizing a method in FIG. 2 according to an embodiment of the present disclosure. As shown in FIG. 3, the procedure includes the following steps.

Step 301: The autocorrelation analysis method is employed to find the best matching point, obtain the pitch period (P0) corresponding to the best matching point, initialize the best pitch period (BP), resulting in BP=P0, and record the best corresponding (BC) value.

In this step, the best matching point (BK) refers to the location of the k point corresponding to the BC among the matching values during the search process. The BC can be expressed with the formula (4):

$$BC=\max\{corr(k)|1\leq k\leq \text{MaxPitch}-\text{MinPitch}\} \quad (4)$$

MaxPitch represents the number of sampling points in the data of maximum possible pitch period. MinPitch represents the number of sampling points in the data of the minimum possible pitch period.

Step 302: N is initialized, so that N=1.

In this step, N represents the location that is N times the frequency corresponding to the P0 point where the best pitch period is located. When N=1, BP=P0.

Step 303: N=N+1 and P=P0/N are set. That is, the frequency corresponding to the actual pitch period (P) is set to be N times of the frequency corresponding to the P0.

Step 304: A judgment is made about whether the P that is obtained in step 303 is greater than or equal to the minimum possible pitch period. If yes, the process proceeds to step 305; otherwise, the process ends.

In this step, it is checked whether P is greater than or equal to the minimum possible pitch period. Usually, the minimum possible pitch period is 2.5 ms, and corresponds to 20 sampling points at the sampling rate of 8 kHz. If P is smaller than the maximum possible pitch period, the current BP value is the estimated BP, and the process ends.

Step 305: The matching value BC' corresponding to P is obtained.

Specially, suppose that the matching value corresponding to BC(k) is the best matching value, then the relationship between the pitch period (P) and K is as follows:

$$P=P\max-(k-1)\ k=1\sim(P\max-P\min) \quad (5)$$

Step 306: A judgment is made about whether BC' meets the preset condition. If yes, the process proceeds to step 307; otherwise, the process returns to step 303.

In this step, the preset condition can be BC'≥a×BC, where, a is a constant, whose value can be 0.85 according to experiences.

Step 307: The BP is updated, so that BP=P. The process proceeds to step 303.

Figure 7:
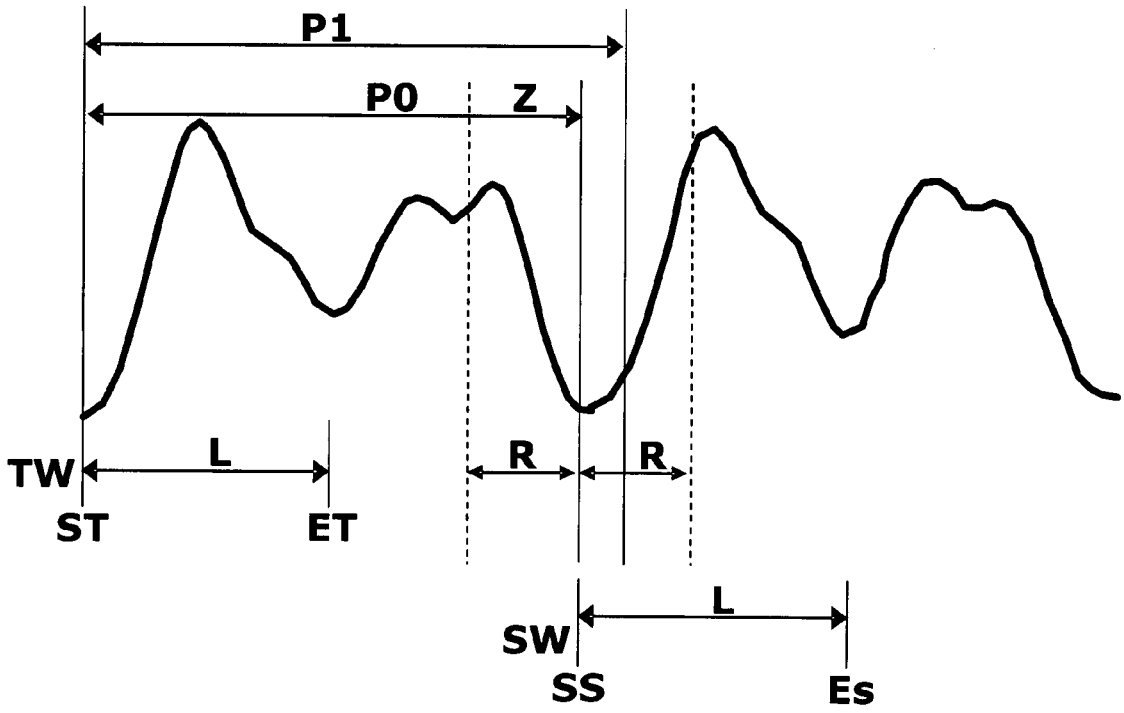
FIG. 7 is a flowchart of tuning the pitch period of the data after the lost frame according to an embodiment of the present disclosure.

After the preceding process is complete, all the factors of the initial pitch period that are greater than the minimum possible pitch period value are found, and a BP can be selected among these factors. In the preceding process, however, the matching values of more than two factors may be greater than or equal to 0.85 BC. In the process as shown in FIG. 7, the factor with the maximum frequency multiplication, that is, the factor with the minimum value, is selected finally. The process in FIG. 7 can also be set as follows: When the matching value of a factor meets the corresponding condition, the factor is regarded as the BP, and the process ends.

In step 307, the BC is updated with the current BC', that is, BC=BC'. In this case, the factor is compared with the better value that is selected previously instead of the initial pitch period P0.

Furthermore, in terms of the error caused by the autocorrelation method, in step 303 or 305, the P' with the maximum matching value can be selected in the area around P, P' is replaced by P, and then P is corrected to reduce the impact of the error. The specific process is as follows: Searching in the area around k corresponding to P to find k' with the maximum matching value BC. The pitch period corresponding to k' is P'. At the 8 kHz sampling rate, searching three points near k can achieve good effect.

Figure 4:
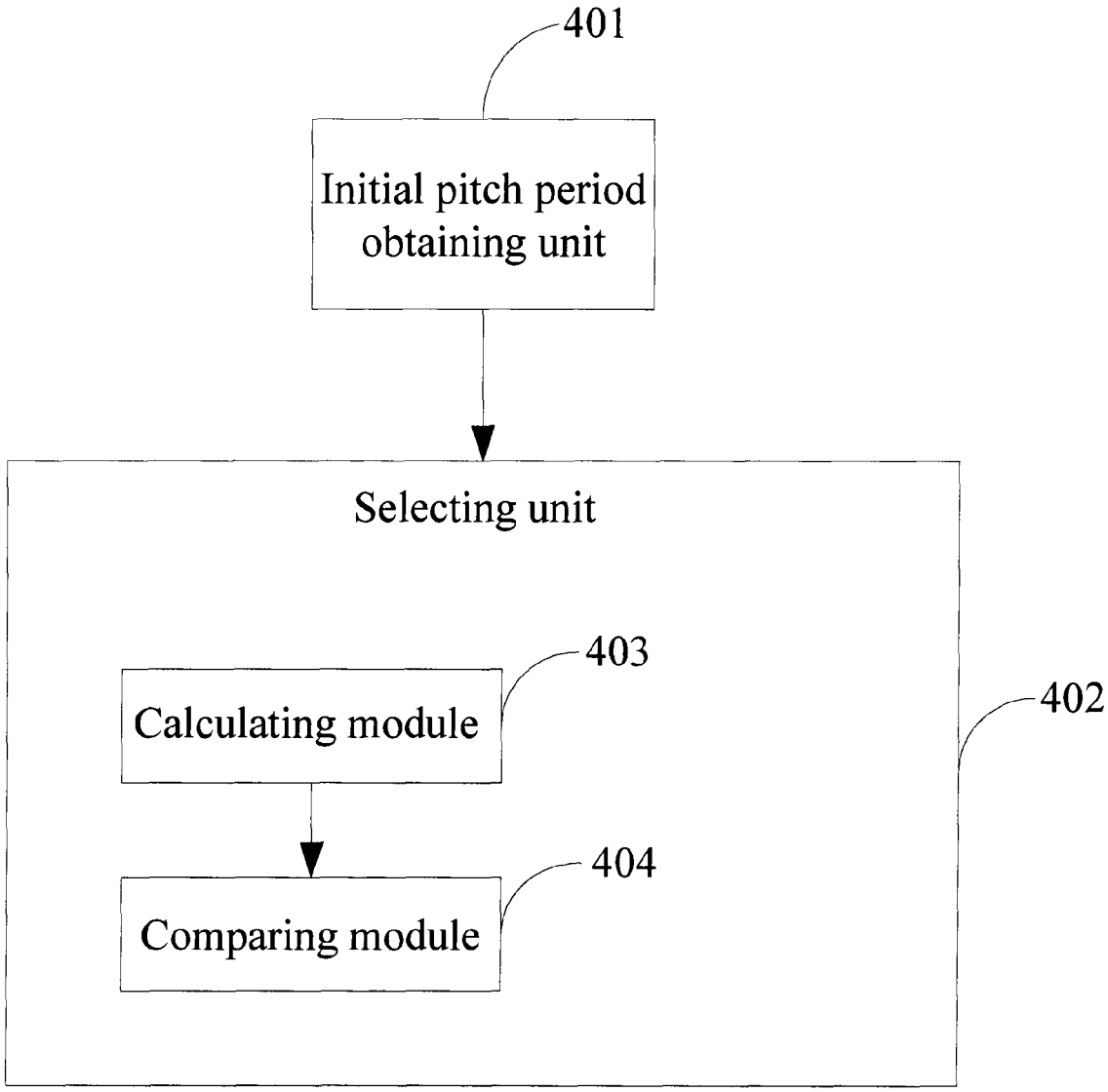
FIG. 4 shows the structure of a device for estimating a pitch period according to an embodiment of the present disclosure.

FIG. 4 shows the structure of a device for estimating a pitch period according to an embodiment of the present disclosure. As shown in FIG. 4, the device includes:

an initial pitch period obtaining unit 401, adapted to obtain the initial pitch period of the known voice data, and send the pitch period to the selecting unit 402; and the selecting unit 402, adapted to select one or more pitch periods, whose corresponding frequencies are lower than or equal to the frequency corresponding to the lowest possible pitch period, as candidate pitch periods, where said one or more pitch periods' frequencies are one or more times higher than the frequency corresponding to the initial pitch period, and select a pitch period from the initial pitch period and the candidate pitch periods as the final estimated pitch period of the history data.

In FIG. 4, the selecting unit 402 includes:

a calculating module 403, adapted to calculate the matching values corresponding to the initial pitch period and each candidate pitch period, and send the matching values to the comparing module 404; and a comparing module 404, adapted to compare the received matching values corresponding to the initial pitch period and each candidate pitch period, select the best matching value, and take the pitch period corresponding to the best matching value as the final estimated pitch period of the known voice data.

The selecting unit 402 in FIG. 4 may further be adapted to search in the preset range around the matching point corresponding to each candidate pitch period to find a matching point with the best matching value, replace the candidate pitch period with the pitch period corresponding to the matching point, and select a pitch period from the initial pitch period and the candidate pitch periods after the replacement as the final estimated pitch period of the known voice data.

As previously noted, the goal of estimating the pitch period is to obtain a pitch period of the data that is closest to the lost frame. However, the sampling data of at least 22.5 ms ahead of the lost frame is used when the auto-correction method is adopted to calculate the pitch period. Therefore, an error may occur during calculation of the pitch period of the data that is closest to the starting point of the lost frame. Reducing the estimated error through tuning the obtained pitch period is described in the present disclosure in combination with FIG. 5 and FIG. 6.

Figure 5:
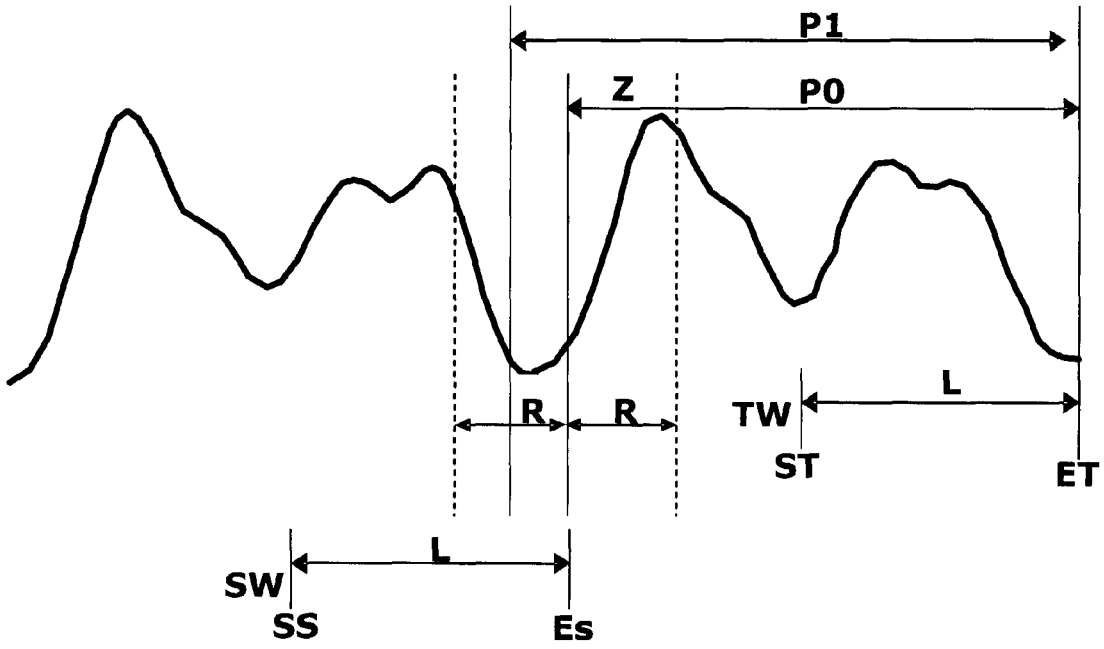
FIG. 5 is a flowchart of tuning the pitch period of the data before the lost frame according to an embodiment of the present disclosure.
Figure 6:
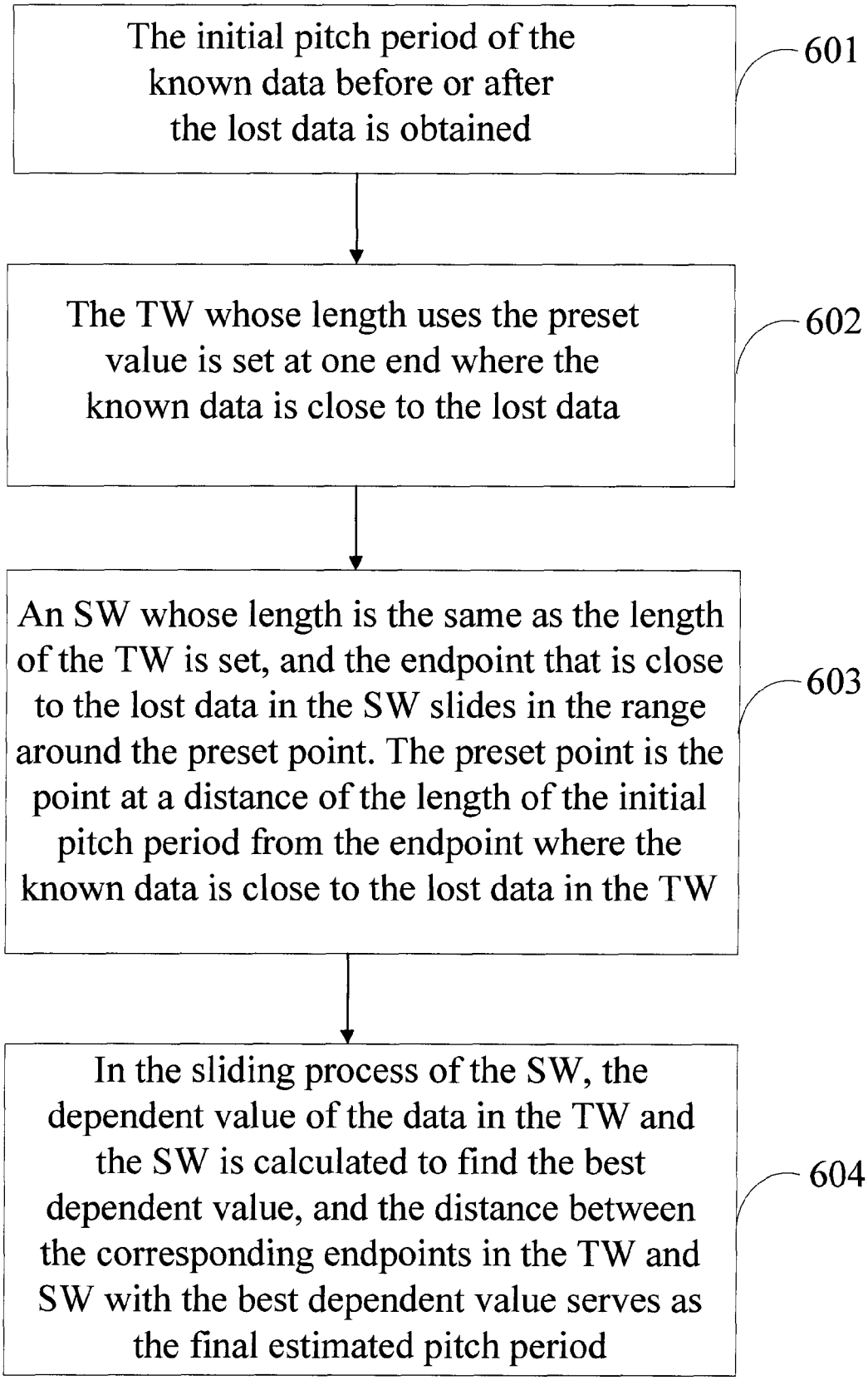
FIG. 6 is a flowchart of a method for tuning a pitch period according to an embodiment of the present disclosure.

FIG. 5 is a flowchart of tuning a pitch period of the data before a lost frame according to an embodiment of the present disclosure. The signal shown in FIG. 5 is the audio signal in the HB. FIG. 6 is a flowchart of a method for tuning a pitch period according to an embodiment of the present disclosure. As shown in FIG. 6, the procedure includes the following steps.

Step 601: The initial pitch period of the history data before or after the lost data is obtained.

In this step, the initial pitch period P0 of the data in the HB is obtained. The P0 can be the pitch period that is obtained by using the autocorrelation analysis method, or the pitch period after frequency multiplication is eliminated by using the method shown in FIG. 1, or the pitch period that is obtained by using other methods.

Step 602: The TW whose length uses the preset value at one end where the history data is close to the lost data is set.

Corresponding to this step, in FIG. 5, the data containing L sampling points before the last sampling point in the HB serves as the TW. If the length of the HB is LEN, the starting point of the TW is $S_T$, and the ending point is $E_T$, then:

$$S_T = LEN - L + 1$$

$$E_T = LEN \tag{6}$$

In this step, L can be a value that is obtained by multiplying 0.55 by P0. The value, however, must be greater than or equal to 0.25×P0.

Step 603: An SW whose length is the same as the length of the TW is set, and the endpoint that is close to the lost data in the SW in the area around the preset point slides. The preset point is the point at a distance of the duration of the initial pitch period from the endpoint where the history data is close to the lost data in the TW.

Corresponding to this step, in FIG. 5, an SW with the length L is set in the HB, and the ending point of the SW slides in the preset range around Z point, which is a point at a distance of the duration of the initial pitch period P0 from the $E_T$ endpoint of the TW. The starting point of the SW is $S_S$, the ending point is $E_S$, and the distance between the Z point and the ending point of HB, that is, the ending point $E_T$ of the TW, is P0. That is, $S_S = S_T - P0$. $E_S$ slides in the preset scope of [Z−R, Z+R].

Step 604: The matching values of the data in the TW and the SW are calculated when the SW slides. The best matching value is found. The distance between the corresponding endpoints of the TW and SW with the best matching value is taken as the pitch period after the tuning.

In this step, the matching values of the SW and TW are calculated when the SW slides. The best matching value, that is, the location of the SW that is most similar to the TW, is found. The distance P1 between the corresponding endpoints of the TW and SW is taken as the final estimated pitch period. The autocorrelation analysis method, such as the formulate (2), can be employed to calculate the matching values of the TW and SW. The total absolute value (BMV) of the amplitude difference between a sampling point in the SW and a sampling point in the TW can be calculated through formula (7) to simplify calculation:

$$BMV(i) = \sum_{k=1}^{L} |x(Z - L + i + k) - x(S_T + k - 1)| - R \le i \le R \tag{7}$$

x(i) represents the ith data in the HB.

When formula (7) is used for calculation, the matching value is inversely proportional to the BMV. Therefore, the minimum BMV is found, that is, BestBMV=min(BMV(i)), −R≤i≤R.

Consistent with some embodiments, step 604 may include searching for the best matching value starting from the position where i=0, and then search on both sides of the location. That is, the BMV value in the position where i=0 is calculated first as the initial BestBMV, and the BMV values in the position where i=±1, i=±2, . . . , i=±R is calculated, and then the obtained BMV values are compared with the BestBMV in turn. If an obtained BMV value is smaller than the BestBMV, the BestBMV value is updated to the BMV value.

The preceding steps are performed to estimate the pitch period P1 that is close to the actual value.

When the pitch period of the data after the lost frame is estimated, the preceding method can be employed to perform the tuning of the initially incorrect pitch period to reduce the error.

FIG. 7 is a flowchart of tuning a pitch period of the data after a lost frame according to an embodiment of the present disclosure. In FIG. 7, the history data after the lost data is adapted to obtain the initial pitch period (P0). The P0 can be the pitch period that is obtained by using the autocorrelation analysis method, or the pitch period after frequency multiplication is eliminated by using the method shown in FIG. 1, or the pitch period that is obtained by using other methods. When the length of the history data after the lost data is inefficient for calculating the pitch period with the autocorrelation analysis method, the P0 can be replaced by the pitch period of the history data before the lost data. Then, the data containing L sampling points after the starting position of the data after the lost data is selected as the TW. L can be the value that is obtained by multiplying 0.55 by P0. When the length of the history data after the lost data is less than the value that is obtained by multiplying 0.55 by P0, L can be reduced, but L must be greater than or equal to the value that is obtained by multiplying 0.25 by P0. The SW whose length is the same as the length of the TW is set, and the starting point of the SW slides in the preset scope [Z−R , Z+R] of Z point, which is the point at a distance of the duration of the initial pitch period (P0) from the $S_T$ endpoint of the TW. The starting point of the SW is $S_S$ and the ending point is $E_S$. The matching values of the data in the SW and the TW are calculated when the SW slides. The best matching value, that is, the location of the SW that is most similar to the TW, is found. The distance P1 between the corresponding endpoints of the TW and SW is taken as the final estimated pitch period. The autocorrelation analysis method, such as the formulate (2), can be used to calculate the matching values of the TW and SW. The BMV between a sampling point in the SW and a sampling point in the TW can be calculated through the formula (7) to simplify calculation. In this case, the best matching value corresponds to the minimum value of BMV.

When the tuning of the pitch period of the data after the lost frame is performed in an embodiment of FIG. 7, the length (L) of the TW must be greater than 0.25×P0. Therefore, seen from the FIG. 7, the pitch period is tuned when the length of the obtained data after the lost frame is greater than or equal to the value that is obtained by multiplying 1.25 by P0.

Figure 8:
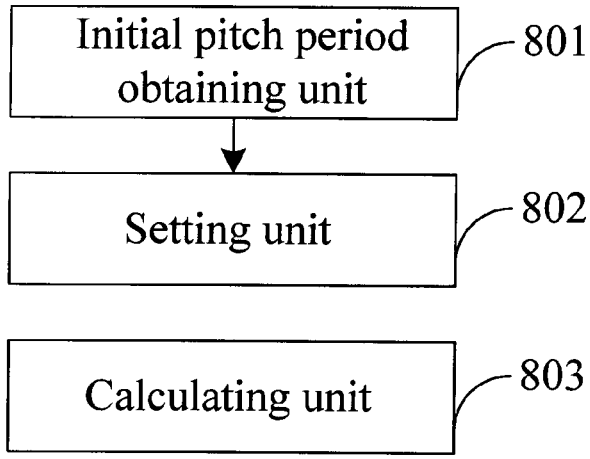
FIG. 8 is a block diagram showing the structure of a device for tuning the pitch period according to an embodiment of the present disclosure.

FIG. 8 is a block diagram showing the structure of a device for the tuning of the pitch period according to an embodiment of the present disclosure. As shown in FIG. 8, the device includes:

- an initial pitch period obtaining unit 801, adapted to obtain history data before or after the lost data to acquire an initial pitch period, and send the pitch period data to a setting unit 802;
- the setting unit 802, adapted to receive the initial pitch period that is sent by the initial pitch period obtaining unit 801, set a TW whose length uses a preset value at one end where the history data is close to the lost data, set an SW whose length is the same as the length of the TW, and slide the endpoint that is close to the lost data in the SW in the area around the preset point, where the preset point is the point at a distance of the length of the initial pitch period from the endpoint where the history data is close to the lost data in the TW; and a calculating unit 803, adapted to calculate the matching values of the data in the TW and the SW in a preset range where the SW can slide around the preset point, find the best matching value, and take the distance between the corresponding endpoints of the TW and SW with the best matching values as the pitch period after the tuning.

In this step, the matching values of the data in the TW and the SW are calculated as follows: A dependent value of the data in the TW and the SW is calculated, and then a value that is proportional to the dependent value is selected as the matching value; or, the total absolute value of amplitude difference between the data in the TW and the SW is calculated, and then a value that is inversely proportional to the total absolute value of amplitude difference is selected as the matching value.

Up to now, a method for estimating the pitch period is provided in an embodiment of the present disclosure. The process of compensating the lost frame, which is, performing PLC, in an embodiment of the present disclosure is described below.

With the existing technology, only the data before the lost frame, that is, history data, is used to fill in the data of lost frame. The pitch period in an audio signal is changed gradually. Therefore, the farther the data is from the lost frame, the weaker the relationship between the data and lost frame will be. With the existing technology, when only the data before the lost frame is used to compensate the lost frame, the phase at the conjunction point of the lost frame and the frame after the lost frame may be incontinuous.

In specific situation, however, is as follows: hiding the lost packet is achieved on the basis of the history data and the received current data after the lost frame when a data frame is lost and the next complete data frame can be received when the system can be delayed. Therefore, some embodiments include performing PLC based on the history data and current data, wherein the history data represents the data before the lost frame, and the current data represents the data after the lost frame.

Figure 9A:
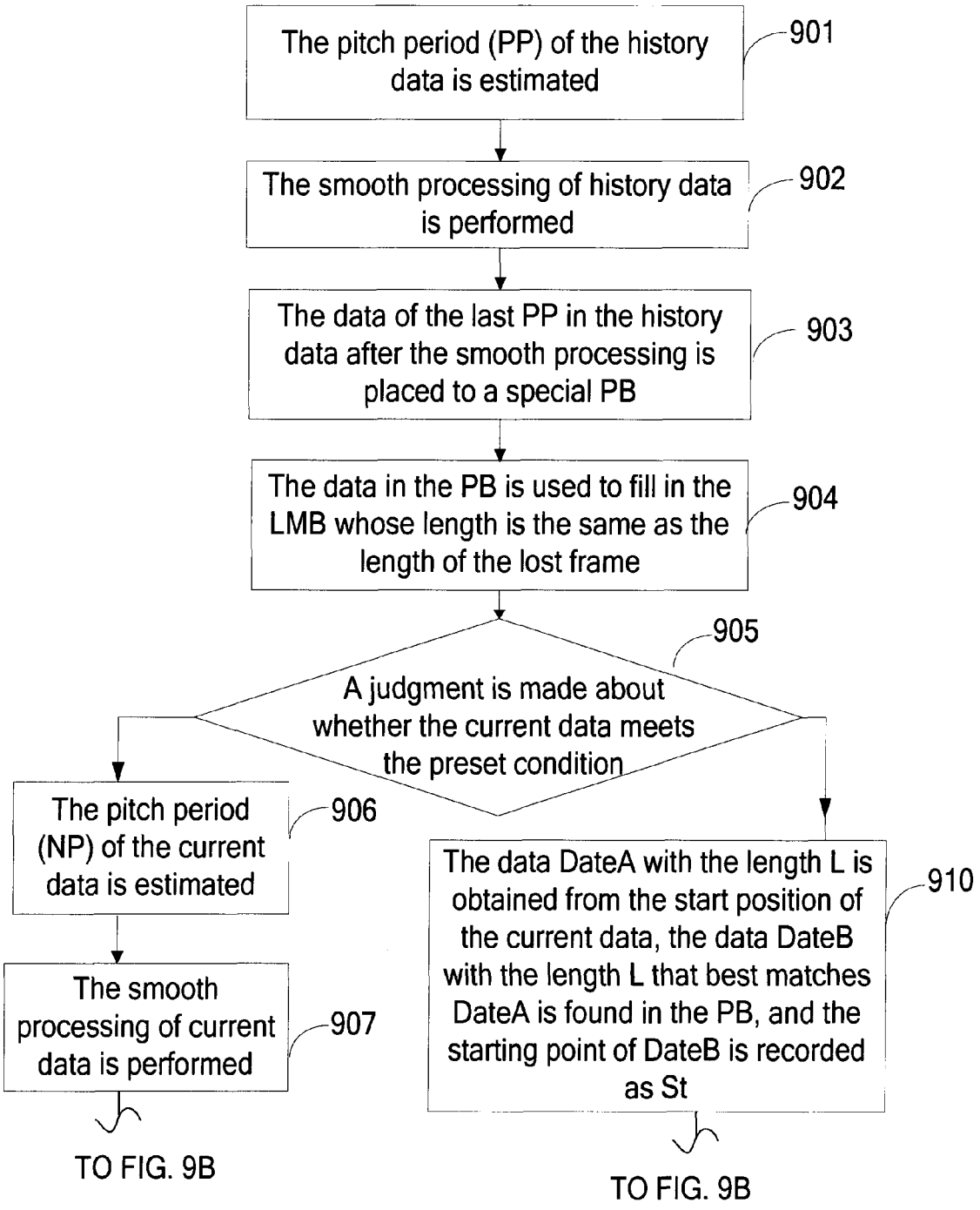
FIG. 9 is a flowchart of a method for performing PLC based on the history data and current data according to an embodiment of the present disclosure.
Figure 9B:
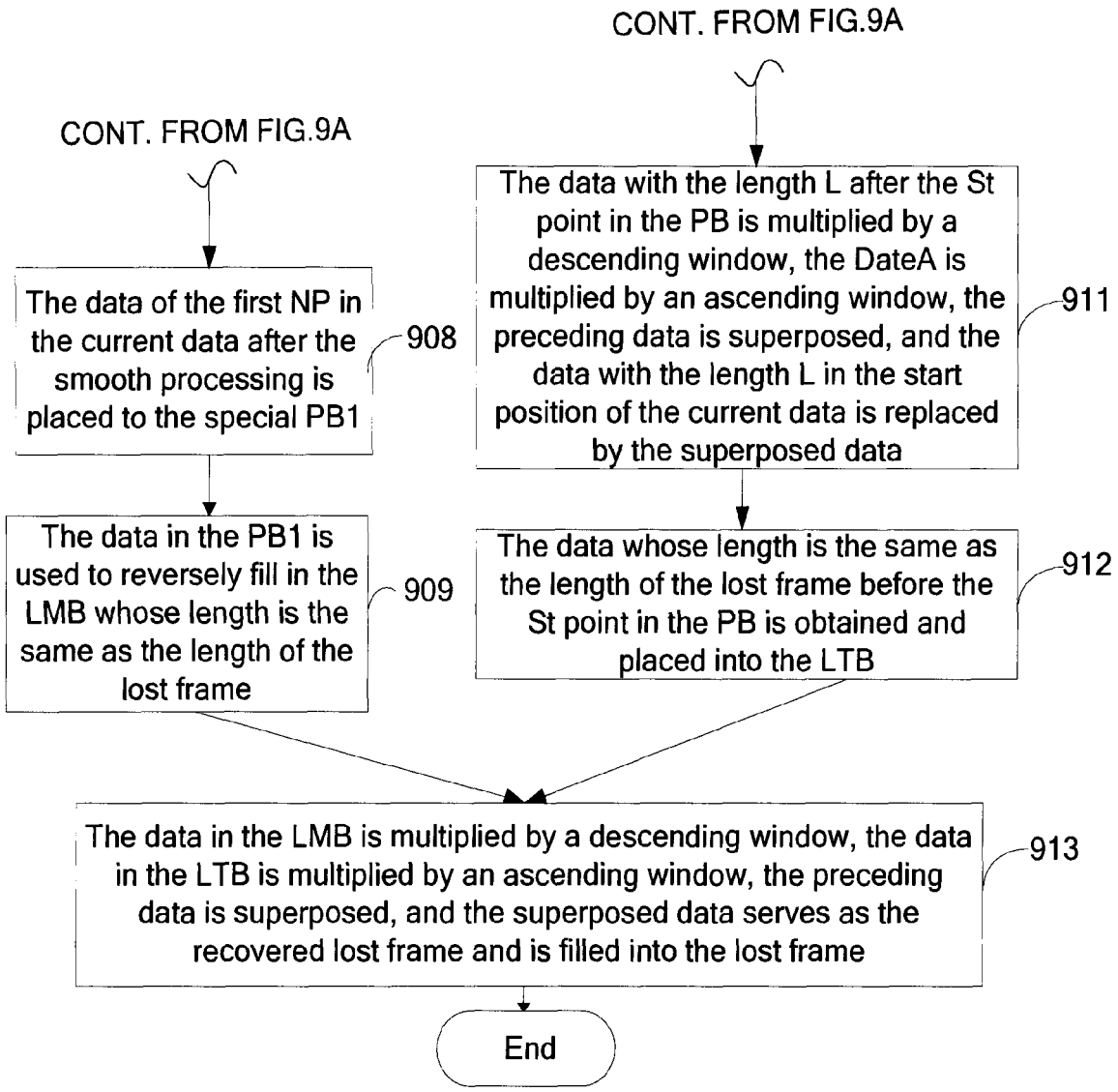

FIG. 9 is a flowchart of a method for performing PLC based on the history data and current data according to an embodiment of the present disclosure. As shown in FIG. 9, the procedure includes the following steps:

Step 901: The pitch period (PP) of the history data is estimated.

In this step, the autocorrelation analysis method can be used to estimate the PP, or the autocorrelation analysis method is used first to estimate an initial pitch period, and then a method shown in FIG. 1 and FIG. 6 in an embodiment of the present disclosure is used to solve the frequency multiplication problem when estimating the initial pitch period, and finally the pitch period after the tuning is taken as the PP in this embodiment.

Step 902: The smooth processing of history data is performed.

In this step, a method for the smooth processing of the last ¼ PP data in the history data is as follows: The ¼ PP data before the last PP in the HB is multiplied by the ascending window, the last ¼ PP data in the HB is multiplied by the descending window, the preceding ¼ PP data is superposed, and then the last ¼ PP data in the HB is replaced by the superposed ¼ PP data to guarantee the smooth transition from the original signal of previous frame in the HB to the filled lost frame signal.

The ascending window and descending window can be defined simply with the following formula:

$$w[i] = \begin{cases} \dfrac{i}{M+i} & 1 \le i \le M, \text{ the ascending window} \\ 1 - \dfrac{i}{M+i} & 1 \le i \le M, \text{ the decending window} \end{cases}$$

where M represents the length of the signal of the window to be added; i represents the subscript corresponding to the ith sampling point related to the signal of the window to be added.

Step 903: The last data with the PP length in the history data after smooth processing is placed to a special PB.

The length of the specific PB is the same as the PP.

Step 904: The data in the PB is used to fill in the LMB whose size is the same as the size of the lost frame.

In this step, a P_OFFSET is required for filling the data in the PB into the LMB. P_OFFSET indicates the position from which the data is obtained from the PB next time to guarantee the smooth junction with the filled data. When the data is obtained from the PB to recover the lost data frame, the P_OFFSET must be moved to the right at a distance of the certain length. If the data from the P_OFFSET to the endpoint of the PB is insufficient, the P_OFFSET is reset to 0, and then the data is obtained from the starting position of the PB. If the data is still insufficient, the step is repeated, until all the required data is obtained.

Step 905: A judgment is made about whether the current data meets the preset condition. If yes, step 906 is performed; otherwise, the process proceeds to step 910.

Figure 10:
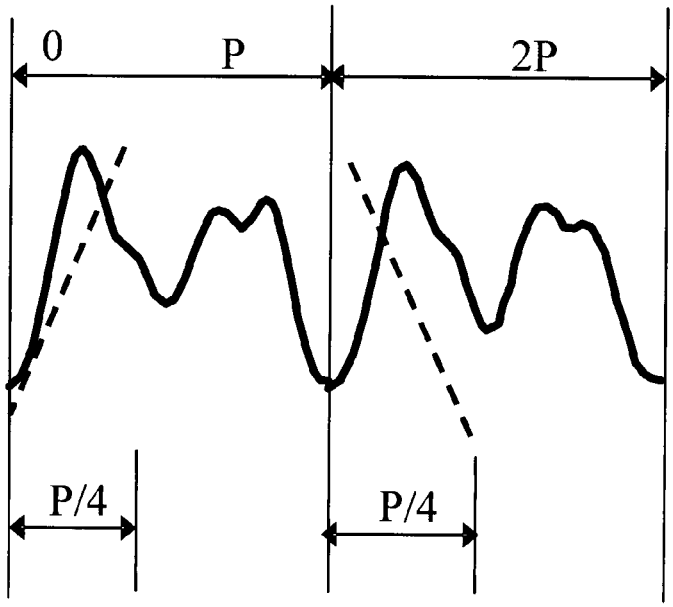
FIG. 10 is a flowchart of smooth processing of a current frame according to an embodiment of the present disclosure.

In this step, the preset condition is whether the length of the current data, that is, the length from the starting position of the first good frame after the lost frame to the currently received data, meets the requirements for the smooth processing of the current frame. FIG. 10 shows a flowchart of smooth processing of a current frame according to an embodiment of the present disclosure. As shown in FIG. 10, the smooth processing of the current data is performed as follows: The ¼ pitch period (P) data after the first pitch period of the current data is multiplied by the descending window, the first ¼ pitch period data starting from the current data is multiplied by the ascending window, the preceding ¼ P data is superposed, and then the first ¼ P data starting from the current data is replaced by the superposed ¼ P data. The purpose of the processing is the same as the purpose of smooth processing of history data in step 902, that is, to guarantee the smooth transition between the original signal of the current data and the lost frame signal when the current data is used reversely to fill in the lost frame.

In this step, because the pitch period of the current data is unknown, the PP of the history data can be used to judge whether the current data meets the preset condition. For example, the judgment condition that is set to the length of the current data Date-SZ must meet the following condition:

$$\text{Date-}SZ \geq PP + PP/4$$

Step 906: The pitch period (NP) of the current data is estimated.

In this step, the autocorrelation analysis method can be used to estimate the NP, or the autocorrelation analysis method is used to estimate an initial pitch period, and then a method shown in FIG. 1 and FIG. 6 in an embodiment of the present disclosure is used to solve the frequency multiplication problem when estimating the initial pitch period, or finally the pitch period after the tuning is taken as the NP in this embodiment.

Step 907: The smooth processing of current data is performed.

In this step, the method shown in FIG. 10 is used to perform smooth processing of the current data.

Step 908: The data of the first NP in the current data after smooth processing is placed to the special PB1.

Step 909: The data in the PB1 is inversely filled to the LTB whose length is the same as the lost frame. The process proceeds to step 913.

In this step, the process of reversely filling the data in the PB1 into the LTB is similar to the process of filling the data in the PB into the LMB in step 1304. Being in the reverse order of the process in step 1304, the process in this step is called reverse filling.

Figure 11:
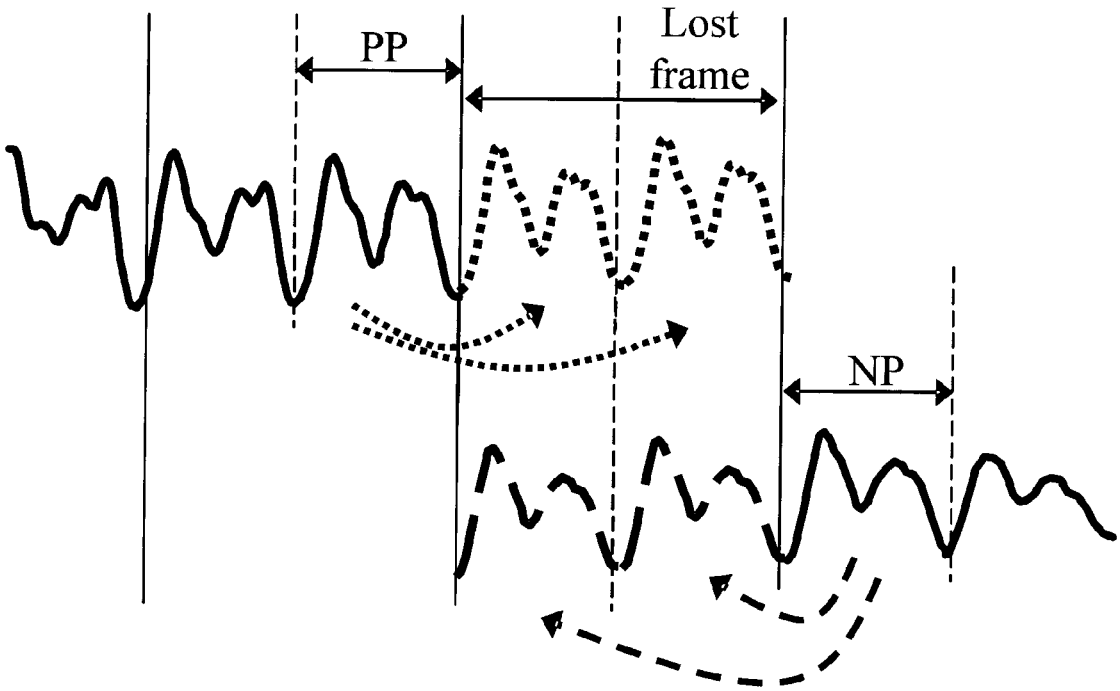
FIG. 11 shows a process of reversely filling in the lost data with the current data according to an embodiment of the present disclosure.

FIG. 11 shows the process of reversely filling in the lost data with the current data according to an embodiment of the present disclosure. In FIG. 11, after the process of filling the last data with the PP length in the history data to the lost data is compared with the process of filling the starting data with the NP length in the current data to the lost data, it can be seen that the history data is used for filling from the left to the right, and the current data is used for filling from the right to the left.

Step 910: The data DateA with the length L is obtained from the start position of the current data, the data DateB with the length L that best matches DateA is found in the PB, and the starting to point of DateB is recorded as St.

Figure 12:
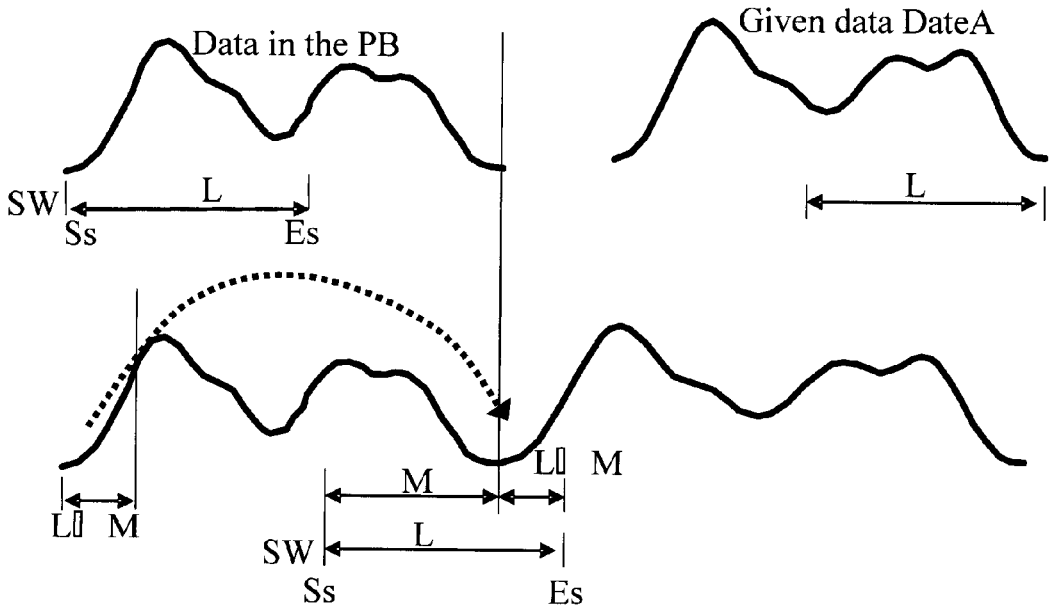
FIG. 12 shows a process of finding the waveform that best matches a given waveform from the pitch buffer according to an embodiment of the present disclosure.

FIG. 12 shows a process of finding the waveform that matches a given waveform from the pitch buffer according to an embodiment of the present disclosure. As shown in FIG. 12, the SW with the length L is set in the PB. The starting point $S_S$ of the SW slides from the starting point of the PB to the right gradually and finally arrives at the ending point of the PB. When the SW slides, the matching value of the data in the SW and the given data DateA is calculated. After the Ss point in the SW slides to the right for a certain distance, the ending point $E_S$ exceeds the scope of the PB, that is, the length M between $S_S$ and $E_S$ is smaller than L. In this case, the data with the length of L-M from the start position of the PB is copied to the end of the PB to meet the matching requirements. Then, the merged data with the length L in the SW is matched with the given data DateA.

In this step, L can be the value that is obtained by multiplying 0.55 by PP.

Step 911: The ¼ PP data DateB after the St point in the PB is multiplied by a descending window, the ¼ pitch period data DateA from the start position of the current data is multiplied by an ascending window, the preceding ¼ PP data is superposed, and then the ¼ PP data starting from the start position of the current data is replaced by the superposed data.

The operation in this step guarantees the smooth connection between the current data and lost data.

Step 912: The data whose length is the same as the length of the lost data is obtained before the St point of the PB, and added to the LTB.

In this step, when the length between the St point of PB and the starting point of PB is smaller than the length of the required data, that is, smaller than the length of the lost data, the data is obtained to the left starting from the ending point, until the data with the required length is obtained.

Step 913: The data in the LMB is multiplied by a descending window, the data in the LTB is multiplied by an ascending window, the preceding data is superposed, and then the superposed data serves as the recovered lost frame and is filled to the lost frame.

Up to now, the process of performing PLC is completed based on the history data and current data.

Of course, in the flow shown in FIG. 9, the judgment process in step 905 can be omitted, and the process proceeds to steps 906, 907, 908, 909, and 913, or to steps 910, 911, 912, and 913 after the step 904 is performed.

In step 910, when DateB which matches DateA is found in the PB, the location of initial matching point is set to the P_OFFSET point of the PB that is obtained in step 904, and then the matching St point is found around the P_OFFSET point. In this case, the times for matching is reduced, and the computational workload is reduced.

If the lost frame is just located in the transition between the surd and sonant, the method shown in FIG. 9 is used to recover the lost frame. Possibly the energy may be changed abnormally. Therefore, in an embodiment of the present disclosure, the smooth processing of the amplitude of the lost frame must be performed depending on the change of the energy of the frames before and after the lost frame to achieve gradual change of the waveform.

First, L sampling points at the beginning of the current data are obtained, and the energy value (EN) of these L sampling points is calculated. Then, L sampling points that best match the preceding L sampling points are found from the PB, and the energy value (EP) of these L sampling points in the PB is calculated. Finally, the smooth processing of the lost frame data amplitude that is recovered by using the method in FIG. 9 is performed depending on the change of the energy of the frame before and after the lost frame to achieve the aim of smooth transition of energy.

The energy of L sampling points can be calculated by adding the results that are obtained by squaring the amplitude values of L sampling points.

If the ratio of the energy of the frame before the lost frame to the energy of the frame after the lost frame is expressed as Energy Ratio (ER), then ER=EN/EP. Suppose that x represents the sequence of the recovered lost frame data, x(i) represents the ith data in the sequence x, and FRAME_SZ represents the frame length, then the formula (8) can be adapted to correct the energy of the recovered lost frame points one by one:

$$x(i) = x(i) \times \left( i \times \frac{sqrt(ER) - 1}{\text{FRAME_SZ} + 1} + 1 \right) \quad 1 \le i \le \text{FRAME_SZ} \tag{8}$$

The function sqrt means to find a square root.

Figure 13:
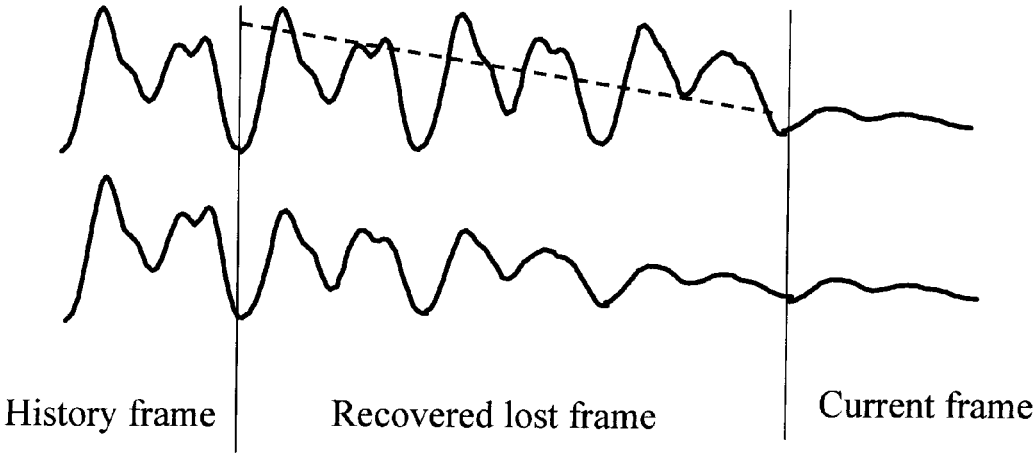
FIG. 13 shows an effect after the smooth processing of amplitude of the recovered lost frame data according to an embodiment of the present disclosure.

FIG. 13 shows an effect after the smooth processing of the amplitude of the recovered lost frame data according to an embodiment of the present disclosure. FIG. 13 shows that the energy at the conjunction point of the recovered lost frame and current frame changes greatly before the smooth processing of amplitude. The energy, however, does not change greatly after the smooth processing of amplitude.

The smooth processing of amplitude of the lost frame can be performed not only on the basis of the ratio of the energy of the frame before the lost frame to the energy of the frame after the lost frame, but also on the basis of the ratio of the maximum amplitude difference between the matching waveform in the frame before the lost frame and the matching waveform in the frame after the lost frame. For example, formula (8) can be used to perform the smooth processing over the amplitude of the lost frame. In this case, however, the ER is the ratio of the maximum amplitude difference between the matching waveform in the frame before the lost frame and the matching waveform in the frame after the lost frame.

Preferably, the smooth processing of amplitude is performed when EP>EN.

Figure 14:
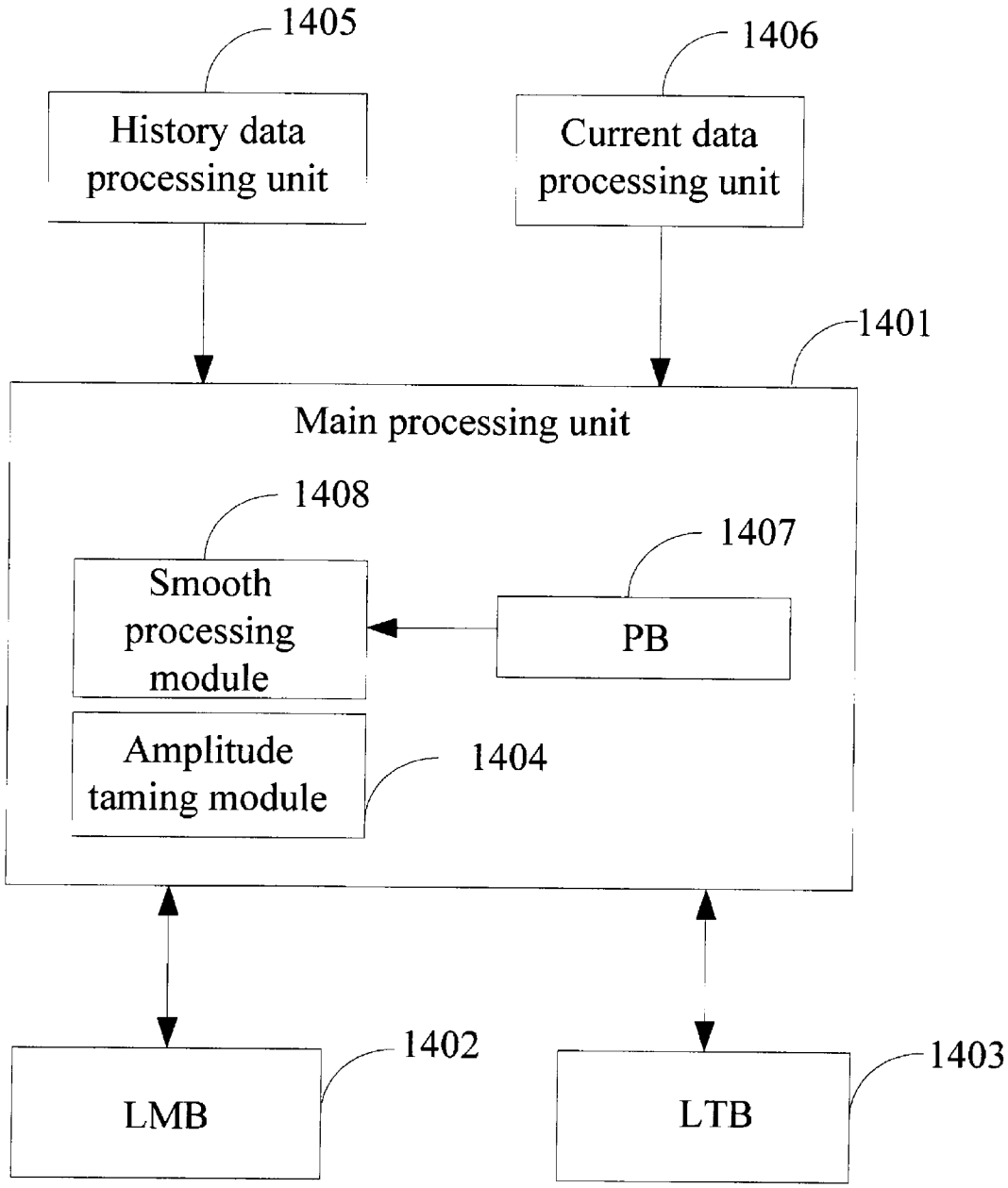
FIG. 14 is a block diagram showing the structure of a device for performing PLC according to an embodiment of the present disclosure.

FIG. 14 is a block diagram showing the structure of a device for performing PLC according to an embodiment of the present disclosure. As shown in FIG. 14, the device includes:

a main processing unit 1401, adapted to use data of the last pitch period in history data to fill in an LMB 1402, use the data of the first pitch period in the current data or the data of the last pitch period in the history data to fill in the LTB 1403, superpose the data in the LMB 1402 and an LTB 1403, and then compensate the lost frame with the superposed data;

the LMB 1402, adapted to store the data that is filled by the main processing unit 1401; and the LTB 1403, adapted to store the data that is filled by the main processing unit 1401.

The length of the LMB 1402 and the length of the LTB 1403 are equal to the length of the lost frame.

The device shown in FIG. 14 further includes a history data processing unit 1405 and a current data processing unit 1406, where the main processing unit includes a PB 1407, a smooth processing module 1408, and an amplitude taming module 1404.

The history data processing unit 1405 is adapted to obtain the pitch period of history data, perform the smooth processing of the data of the last pitch period in the history data, and then send the processed data to the main processing unit 1401.

The current data processing unit 1406 is adapted to obtain the pitch period of current data, perform the smooth processing of the data of the first pitch period in the current data, and then send the processed data to a main processing unit 1401.

The main processing unit 1401 is adapted to use the data of the last pitch period in the history data to fill in the LTB 1403. In the process, the main processing unit 1401 stores the data of the last pitch period in the history data into the PB 1407, obtains the first data whose length uses the preset value from the start position of the data of the first pitch period in the current data, finds the second data that best matches the first data in the PB 1407, obtains the third data whose length is the same as the LTB length before the starting point of the second data in the PB 1407, and then uses the third data to fill in the LTB 1403.

The smooth processing module 1408 is adapted to multiply the data whose length uses the preset value after the starting point of the second data in the PB 1407 by a descending window, multiply the data whose length uses the preset value from the start position of the current data by an ascending window, superpose the preceding data, and replace the data whose length uses the preset value after the starting point of the current data with the superposed data.

The amplitude taming module 1404 is adapted to obtain the radio coefficient between two sets of matching data in the history data before the lost data and the history data after the lost data, and perform the smooth processing of the amplitude of the superposed data according to the ratio coefficient. The main processing unit 1401 uses the data of the amplitude after smooth processing to compensate the lost frame.

In the embodiment shown in FIG. 14, the main processing unit 1401 is used to judge whether the length of the current data is greater than or equal to the preset value. If yes, the main processing unit 1401 uses the data of the first pitch period in the history data after the lost data to fill in the LTB 1403; otherwise, the main processing unit 1401 uses the data of the last pitch period in the history data before the lost data to fill in the LTB 1403.

In the embodiments shown in FIG. 9 and FIG. 14, the lost frame data is recovered on the basis of the current data and history data to implement PLC. Because the data frame after the lost frame, that is, the current data, is used to recover the lost frame in the process of performing PLC, the correlation between the recovered lost frame data and the data after the lost frame is enhanced, and the quality of the recovered voice data is improved. In addition, the further smooth processing of the amplitude of the recovered lost frame data enhances the quality of the recovered voice data.

A method, as shown in FIG. 9, for hiding the lost packet, and the application, as shown in FIG. 14, of the device for performing PLC in a system are described below.

Figure 15:
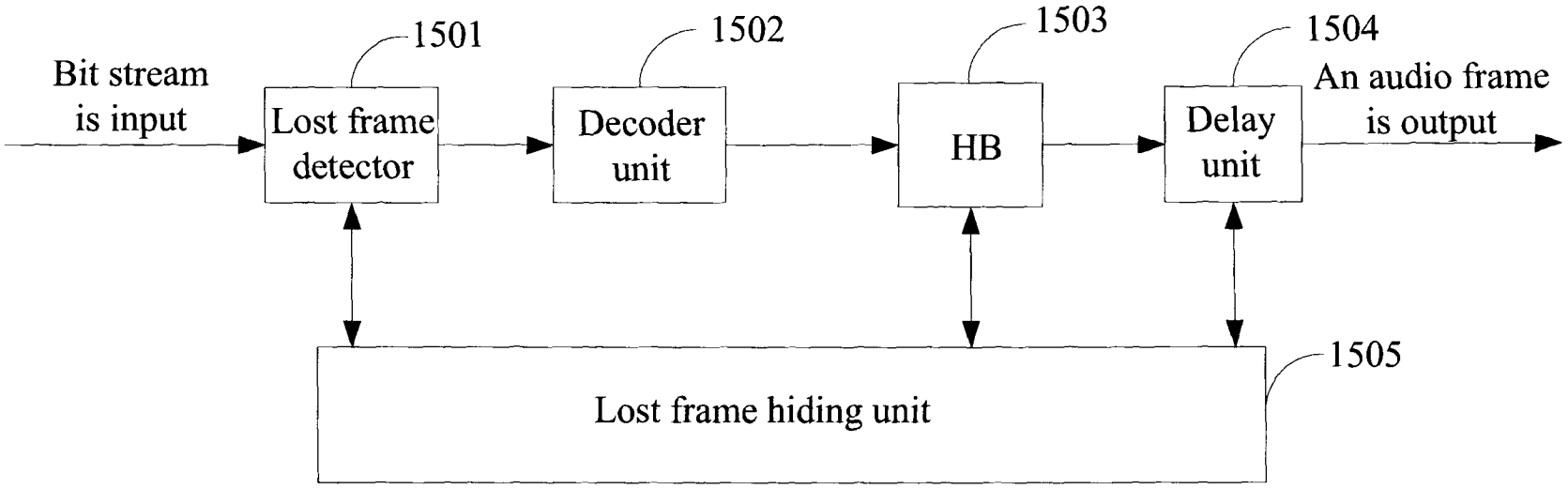
FIG. 15 shows an external connection of a device for performing PLC in a system at the receiving end according to an embodiment of the present disclosure.

FIG. 15 shows an external connection of a device for performing PLC in a system at the receiving end according to an embodiment of the present disclosure. The system at the receiving end can be a decoder. As shown in FIG. 15, the system at the receiving end includes a lost frame detector 1501, a detector unit 1502, an HB 1503, a delay unit 1504, and a lost packet hiding unit 1505.

In FIG. 15, after receiving the bit stream from the network, the lost frame detector 1501 judges whether a data frame is lost. If no data frame is lost, the lost frame detector 1501 transmits a good voice frame to the decoder 1502 for decoding, and the decoder 1502 sends the decoded data to the HB 1503, and then the delay unit 1504 outputs the data in the HB 1503 some time after the delay. If the lost frame detector 1501 detects that one or more data frame is lost, the detector sends the signal indicating that the lost frame is lost to the lost packet hiding unit 1505, and then the lost packet hiding unit 1505 uses a method for hiding the lost packet provided in an embodiment of the present disclosure to obtain the recovered lost frame data and places the recovered lost frame data in the position of the lost frame in the HB 1503. In the system as shown in FIG. 15, on the premise that delay requirement is met, the lost packet hiding unit 1501 needs to implement PLC based on the history data before the lost frame and the data of one or more frames after the lost frame. In a complex network, however, it is unknown whether the data frame before and after the lost frame is lost. Therefore, the lost packet hiding unit 1505 can obtain the state information of the frame that is required for hiding the lost frame through the lost frame detector 1501. Subsequently, the lost packet hiding unit 1505 uses the data in the HB 1503 to compose the lost audio frame according to the state of the frames before and after the lost frame.

Figure 16A:
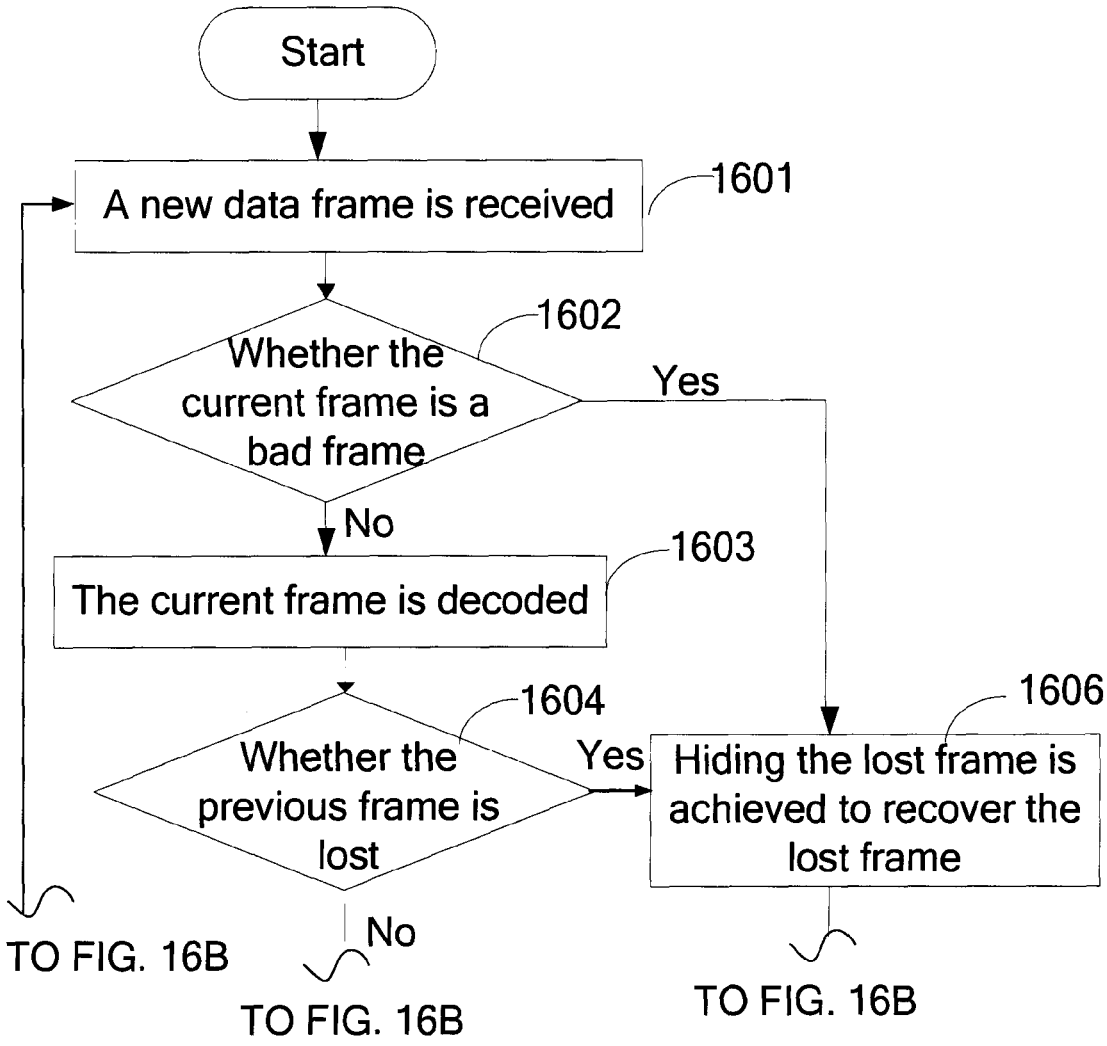
FIG. 16 is a flowchart of a method for performing PLC in an actual system according to an embodiment of the present disclosure.
Figure 16B:
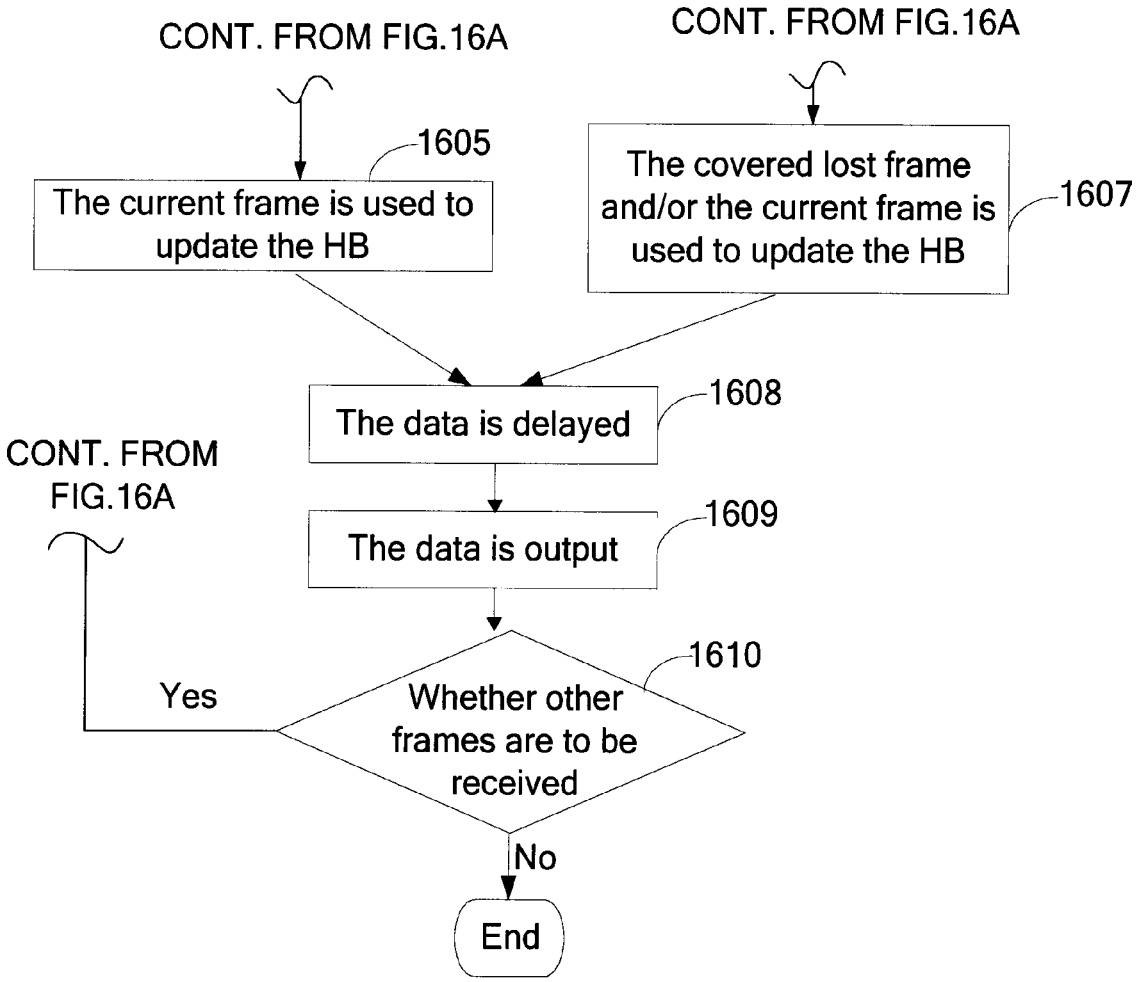

FIG. 16 is a flowchart of a method for performing PLC in the actual system according to an embodiment of the present disclosure. As shown in FIG. 16, the procedure includes the following steps.

Step 1601: A new voice data frame is received by the system at the receiving end.

Step 1602: A judgment is made by the system at the receiving end about whether the received new voice data frame is a bad frame. If yes, the process proceeds to step 1606; otherwise, the process proceeds to step 1603.

Step 1603: The current frame is decoded by the system at the receiving end.

Step 1604: A judgment is made by the system at the receiving end about whether the frame before the current frame is lost. If yes, the process proceeds to step 1606; otherwise, the process proceeds to step 1605.

Step 1605: The HB is updated with the current frame, and the process proceeds to step 1608.

Step 1606: The method for achieving hiding the lost frame is employed to recover the lost frame.

Step 1607: The HB is updated with the recovered lost frame and/or the current frame.

Step 1608: The data in the HB is delayed for a period of time.

In this step, the delay time can be set on the basis of an application scenario. For example, if the required delay time is the time for one or more frames, the delay time can be prolonged when the requirement for delay time of the system is met by considering that the maximum possibly superposed length of the frame during smooth processing of the previous frame is 0.25 times the maximum possible pitch period, which is 15 ms usually, that is, 3.75 ms. For example, when the number of sampling points corresponding to the 1 ms data is SP, the delay time is the longer time between the time for one frame and the time for CEIL(3.75×SP/FRAME_SZ)×FRAME_SZ sampling points. CEIL represents the minimum integer that is greater than the given number of floating points. FRAME_SZ represents the number of sampling point in the data of one frame.

For example, when the frame length of the system is 5 ms, the delay time can be set to 5 ms, that is, the delay time for one frame. If the frame length of the current system is 2 ms, the delay time can be set to MAX(2, CEIL(3.75/2)×2)=4 ms, that is, the delay time for two frames.

Step 1609: The data in the HB is output.

Step 1610: A judgment is made about whether another data frame needs to be received. If yes, the process returns to step 1601; otherwise, the process ends.

In actual application, a judgment about whether to implement PLC is made by using the method for recovering the lost frame based on the history data and current data provided in an embodiment of the present disclosure according to the permitted delay time. For example, when a data frame is lost, the next frame waits in the permitted delay time of the system. If the next frame is a good frame, the method for recovering the lost frame based on the history data and current data provided in an embodiment of the present disclosure can be used to implement PLC. If the data of next frame is lost, the data of next frame is waited in the permitted delay time of the system. If frames are lost continuously and the permitted delay time expires, the history data is used to implement PLC.

To sum up, in an embodiment of the present disclosure, a number is selected from the factors of the initial pitch period and all the initial pitch periods that are greater than the minimum possible pitch period as the estimated best pitch period in the technical solution. In this case, the frequency multiplication problem is solved when the pitch period is estimated. In an embodiment of the present disclosure, the error for estimating the pitch period is reduced by finding the best matching point around the initial pitch period and carrying out the technical solution for the tuning of the estimated initial pitch period according to the location of the best matching point. In an embodiment of the present disclosure, the data of the last pitch period in history data is used to fill in the LMB, the data of the first pitch period in current data or the data of the last pitch period in history data is used to fill in the LTB, the data in the LMB and the LTB are superposed, and then the superposed data is used to compensate the lost frame. In this way, the correlation between the recovered lost frame data and the data after the lost frame is enhanced, and the phase continuity between the recovered lost frame data and the data after the lost frame is further improved. In addition, in an embodiment of the present disclosure, smooth processing of the amplitude of the recovered lost frame is carried out, so that the energy at the conjunction point of the recovered lost frame and the current frame does not change greatly.

Some exemplary embodiments according to the present disclosure are described above, but the present disclosure is not limited to such embodiments. All of the modifications, equivalent replacements, and improvements that are made without departing from the principle of the present disclosure are protected by the present disclosure.

What is claimed is:

1. A method for performing packet loss concealment (PLC), comprising:

filling, by a hardware decoder, data of a pitch period in history data before lost data into a lost frame buffer (LMB);

filling, by the hardware decoder, data of a pitch period in the history data after the lost data into a temporary lost frame buffer (LTB) when a length value of the history data after the lost data is larger than or equal to a preset value; otherwise, filling data of a pitch period in the history data before the lost data into the LTB;

superposing, by the hardware decoder, the data in the LMB and the LTB; and compensating, by the hardware decoder, for a lost frame using the superposed data.

2. The method according to claim 1, wherein:

the data of a pitch period in the history data before the lost data is as follows: data of a last pitch period of the history data before the lost data; and the data of a pitch period in the history data after the lost data is as follows: a first pitch period data of the history data after the lost data.

3. The method according to claim 2, wherein, before using the data of the last pitch period of the history data before the lost data to fill in the LMB, the method further comprises:

performing, by the hardware decoder, a smooth processing on the data of the last pitch period of the history data before the lost data.

4. The method according to claim 2, wherein, before using the first pitch period data of the history data after the lost data to fill in the LMB, the method further comprises:

performing, by the hardware decoder, a smooth processing on the first pitch period data of the history data after the lost data.

5. The method according to claim 4, wherein, performing the smooth processing of the first pitch period data of the history data after the lost data comprises:

multiplying, by the hardware decoder, a preset length data after the first pitch period of the history data after the lost data by a descending window, multiplying, by the hardware decoder, the first preset length data of the history data after the lost data by an ascending window, superposing, by the hardware decoder, the preceding preset length data, and replacing, by the hardware decoder, the first preset length data of the history data after the lost data with the superposed data.

6. The method according to claim 2, wherein reverse filling is performed when the first pitch period data of the history data after the lost data is used to fill in the LMB.

7. The method according to claim 2, wherein the process of using the data of the last pitch period of the history data before the lost data to fill in the LMB comprises:

storing, by the hardware decoder, the data of the last pitch period of the history data before the lost data into the PB, and obtaining, by the hardware decoder, a first data whose length uses the preset value from the start position of the history data after the lost data;

finding, by the hardware decoder, a second data that best matches the first data in the pitch buffer (PB);

obtaining, by the hardware decoder, a third data in the LTB whose length is the same as the length before a starting point of the second data in the PB; and storing, by the hardware decoder, the third data into the LTB.

8. The method according to claim 7, further comprising:

performing, by the hardware decoder, a smooth processing of the data whose length uses a preset value from a start position of the history data after the lost data.

9. The method according to claim 8, wherein performing the smooth processing of the data whose length uses the preset value from the start position of the history data after the lost data comprises:

multiplying, by the hardware decoder, the data whose length uses the preset value from the starting point of the second data in the PB by a descending window, multiplying, by the hardware decoder, the data whose length uses the preset value from the start position of the history data after the lost data by an ascending window, superposing, by the hardware decoder, the preceding data, and replacing, by the hardware decoder, the data whose length uses the preset value from the start position of the history data after the lost data with the superposed data.

10. The method according to claim 7, wherein the process of using the data of the last pitch period in the history data before the lost data to fill in the LMB further comprises:

using, by the hardware decoder, an offset pointer to indicate a current position of the data of the last pitch period, obtaining, by the hardware decoder, the data from the current position each time to fill in the LMB, and updating, by the hardware decoder, a position of the offset pointer in real time; and the process of finding the second data that best matches the first data in the PB comprises:

finding, by the hardware decoder, the second data that best matches the first data in the preset range around the position that is indicated by the offset pointer in the PB.

11. The method according to claim 2, wherein superposing the data in the LMB and LTB comprises:

multiplying, by the hardware decoder, the data in the LMB by a descending window, multiplying, by the hardware decoder, the data in the LTB by an ascending window, and superposing, by the hardware decoder, the preceding data.

12. The method according to claim 1, wherein, before using the superposed data in the LMB and LTB to compensate for the lost frame, the method further comprises:

storing, by the hardware decoder, the data of the last pitch period of the history data before the lost data to the PB, and obtaining, by the hardware decoder, data whose length uses a preset value from a start position of the history data after the lost data;

finding, by the hardware decoder, data that best matches the data whose length uses the preset value in the PB;

obtaining, by the hardware decoder, a ratio coefficient between the data whose length uses the preset value and the found matching data;

performing, by the hardware decoder, smooth processing of an amplitude of the superposed data according to the ratio coefficient; and using, by the hardware decoder, the data after the smooth processing of the amplitude to compensate for the lost frame.

13. The method according to claim 12, wherein, the ratio coefficient is a ratio of an energy of the data whose length uses the preset value to an energy of the found matching data, or the ratio coefficient is the ratio of the maximum amplitude difference in the data whose length uses the preset value to the maximum amplitude difference in the found matching data.

14. The method according to claim 1, wherein the preset value is 5/4 times of the pitch period of the history data before the lost data.

15. A device for performing packet loss concealment (PLC), comprising:

a main processor, configured to fill data of a pitch period in history data before lost data into a lost frame buffer (LMB);

fill data of a pitch period in the history data after the lost data into a temporary lost buffer (LTB) when a length value of the history data after the lost data is larger than or equal to a preset value; otherwise, fill data of a pitch period in the history data before the lost data into the LTB;

superpose the data in the LMB and the LTB; and compensate for a lost frame using the superposed data;

the LMB, configured to store the data filled by the main processor, a length of the LMB being the same as a length of the lost data; and the LTB, configured to store the data filled by the main processor, a length of the LTB being the same as the length of the lost data.

16. The device according to claim 15, wherein the main processor is further configured to:

judge whether a length value of the history data after the lost data is larger than or equal to the preset value; and if yes, use the data of the first pitch period in the history data after the lost data to fill in the LTB; or, otherwise, use the data of a last pitch period in the history data before the lost data to fill in the LTB.

17. The device according to claim 15, wherein, the main processor is configured to use the data of the last pitch period in the history data before the lost data to fill in the LMB, and use the data of the first pitch period in the history data after the lost data or the data of the last pitch period in the history data before the lost data to fill in the LTB.

18. The device according to claim 15, further comprising:

a history data processing unit, configured to obtain the pitch period of the history data before the lost data, and send the data of the last pitch period in the history data before the lost data to the main processor; and a current data processing unit, configured to obtain the pitch period of the history data after the lost data, and send the data of the first pitch period in the history data after the lost data to the main processor.

19. The device according to claim 18, comprising at least one of:

the history data processing unit, further configured to perform a smooth processing of the data of the last pitch period in the history data before the lost data, and then send the processed data to the main processor; or the current data processing unit, further configured to perform a smooth processing of the data of the first pitch period in the history data before the lost data, and then send the processed data to the main processor.

20. The device according to claim 15, wherein the main processor comprises:

a pitch buffer (PB), configured to store the data of the last pitch period in the history data before the lost data; and wherein the main processor is further configured to store the data of the last pitch period in the history data before the lost data into the PB, and obtain first data whose length uses a preset value from a start position of the data of the first pitch period in the history data after the lost data; find second data that best matches the first data in the PB;

obtain third data whose length is the same as the length of the LTB from a starting point of the second data in the PB; and use the third data to fill in the LTB.

21. The device according to claim 20, wherein the main processor further comprises:

a smooth process module, configured to multiply the data whose length uses the preset value from the starting point of the second data in the PB by a descending window, multiply the data whose length uses the preset value from the start position of the history data after the lost data by an ascending window, superpose the preceding data, and replace the data whose length uses the preset value from the start position of the history data after the lost data with the superposed data.

22. The device according to claim 16, wherein the main processor further comprises:

an amplitude taming module, configured to obtain a ratio coefficient between two sets of matching data in the history data before the lost data and the history data after the lost data, and perform smooth processing of the amplitude of the superposed data according to the ratio coefficient; and wherein the main processor is further configured to use the data after the smooth process of the amplitude to compensate the lost frame.

23. A system, at a receiving end, that hides a lost packet, comprising:

a lost frame detector, configured to receive a bit stream from a network, and judge whether a data frame is lost, wherein if the detector detects that no data frame is lost, the detector transmits good data frames to a decoder unit for decoding, and if the detector detects that one or more data frames are lost, the detector sends a signal indicating a loss of the data frame to a lost packet hiding unit;

a hardware decoder, configured to decode the complete data frames that are sent by the lost frame detector, and send the decoded data frames to a history buffer (HB);

the HB, configured to store data frames that are sent by the decoder unit;

a delay unit, configured to control a delay output of the data frames in the HB; and the lost packet hiding unit, configured to recover the lost data frames, and place recovered data frames in positions corresponding to the lost data frames in the HB;

wherein:

data of a pitch period in history data before the lost data is used to fill in a lost frame buffer (LMB);

data of the pitch period in the history data after the lost data is used to fill in a temporary lost buffer (LTB) when a length value of the history data after the lost data is larger than or equal to a preset value; otherwise, data of the pitch period in the history data before the lost data is used to fill in the LTB;

and the data in the LMB and the LTB is superposed, and the superposed data is used to compensate the lost frame.

* * * * *